United States Patent [19]

Mitsuya et al.

[11] Patent Number: 5,023,464

[45] Date of Patent: Jun. 11, 1991

[54] FIXING APPARATUS AND RECORDING APPARATUS

[75] Inventors: Teruaki Mitsuya, Katsuta; Shigetaka Fujiwara, Hitachi; Michio Endou, Niihari; Akira Terakado, Hitachi, all of Japan

[73] Assignees: Hitachi, Ltd.; Hitachi Koki Co., Ltd., both of Tokyo, Japan

[21] Appl. No.: 584,616

[22] Filed: Sep. 19, 1990

[30] Foreign Application Priority Data

Sep. 20, 1989 [JP] Japan ..... 1-244855
Oct. 19, 1989 [JP] Japan ..... 1-270290

[51] Int. Cl.[5] ..... G03G 15/22; G03G 15/20

[52] U.S. Cl. ..... 355/283; 355/282; 355/284; 355/285

[58] Field of Search ..... 355/282, 283, 285, 290, 355/286, 289, 284, 300, 315; 19/144, 296, 161.1, 163; 15/208, 209 R, 230

[56] References Cited

U.S. PATENT DOCUMENTS 3,706,491 12/1972 Furman et al. ..... 355/283 X
3,861,860 1/1975 Thettu et al. ..... 355/283 X
3,861,861 1/1975 Thettu ..... 355/283 X
3,868,744 3/1975 Thettu ..... 355/283 X
4,277,161 7/1981 Calabrese ..... 355/282
4,525,058 6/1985 Hirabayashi et al. ..... 355/282
4,821,077 4/1989 Hayakawa et al. ..... 355/283
4,829,931 5/1989 Mogi ..... 355/289 X
4,926,218 5/1990 Fukao ..... 355/283
4,949,096 8/1990 Ogawa et al. ..... 355/285 X

*Primary Examiner*—A. T. Grimley
*Assistant Examiner*—Sandra L. Hoffman
*Attorney, Agent, or Firm*—Kenyon & Kenyon

[57] ABSTRACT

In a heat roll consisting of a mandrel and a surface layer, this invention comprises a fixing apparatus and a recording apparatus, wherein a thickness of the surface layer is formed not exceeding the thickness determined by a square root of the product of a heat diffusion rate of the surface material and a nip time required for a form to pass a nip zone, and a thickness of the mandrel is formed not less than the thickness determined by a square root of the product of a heat diffusion rate of the mandrel material and a one rotational period of the mandrel. Since the surface layer and the mandrel are so specified for the thickness as mentioned, a quantity of heat flowing from the mandrel into the surface layer multiplies, and thus a high fixing strength is obtainable. The fixing apparatus and the recording apparatus are provided further with a cleaning device high in cleaning capacity.

25 Claims, 18 Drawing Sheets

| INITIAL TEMPERATURE °C | HEAT CONDUCTIVITY W/(m·K) | HEAT DIFFUSION RATE m²/s |
|---|---|---|
| 20 | 0.110 | $6.90 \times 10^{-8}$ |
| 20 | 0.106 | $1.02 \times 10^{-7}$ |
| 190 | 0.251 | $1.11 \times 10^{-7}$ |
| 190 | $2.18 \times 10^{2}$ | $8.15 \times 10^{-5}$ |

FIXING APPARATUS AND RECORDING APPARATUS

BACKGROUND OF THE INVENTION

1. Field of the Invention

This invention relates to a recording apparatus employing an electrophotography system such as printer, copying machine, facsimile or the like, and is particularly concerned with a fixing apparatus for fixing a toner image to a recording medium where the image is formed on a surface of the recording medium.

2. Description of the Prior Art

A prior art fixing system has at least a heat roll and a back-up roll. In this specification, there may be a case where the heat roll is abbreviated as HR, and the back-up roll as BR. Then, both the rolls HR and BR may be called fixing rollers coupled to one another. In the fixing system, HR is heated, and HR and BR rotate as coming in contact with each other. The drive roll in this case is either one or both of HR and BR. Both HR and BR coming in contact with each other may form a contact face. The contact face is then called a nip zone. A recording paper having a toner image not yet fixed passes the nip zone as nipped between HR and BR. In this case, the unfixed toner is heated by HR to melt. The melted toner passes the nip zone and then solidifies to fix on the recording paper. A series of such operations is called fixation.

Generally in the fixing system, it is preferable that the toner, after fixation, sticks to the recording paper satisfactorily hard, and even in case 20 image after is rubbed or bent after fixation, the toner will never come off. In this specification, such sticking strength is called fixing strength.

However, in the prior art fixing system, when the fixing roller couple rotate at high speed, it is difficult to obtain a satisfactory fixing strength only through the fixing roller couple. In this case, the fixing strength will be increased simply from enhancing a meltability of the toner without applying an improvement to the fixing system particularly therefor. However, enhancing a meltability of the toner can shorten a term of preservation. A stability of development deteriorates at the same time, a fog arises on an image, and where striking the toner blocks within a developing machine, thus coming to unprintableness. Further, the toner scatters externally of the developing machine, and adheres to a conveyor and other elements to cause an erroneous printing on the recording paper. Where the toner strikes, a coefficient of friction of the conveyor drops. This leads to an incapability of conveyance, thus exerting an influence on the system entirely. Accordingly, it is necessary to obtain a satisfactory fixing strength under the toner condition that such disadvantage will never be caused. Thus, as mentioned in Photographic Science and Engineering 27, (1983) pp 19–25, there may be a case where a preheater for heating a recording paper and an unfixed toner supplementarily from behind a printing surface of the recording paper is provided immediately ahead of the fixing roller couple in the direction where the recording paper is carried.

It is then most general that HR comprises a cylinder having a structure with the surface of a mandrel which is a metallic hollow cylinder coated with a nonviscous heat-resisting material such as fluororesin or silicone rubber, and that of having a structure with a heating element such as halogen lamp or the like provided centrally of the cylinder. In this specification, the nonviscous coat is called a surface layer. The surface layer is provided so as to minimize an occurrence of a toner offset phenomenon wherein a toner adheres to the HR surface when the toner passes the nip zone. The heating element operates according to a detection signal of a heat sensor for detecting temperature of the HR surface or thereabout.

Further, the following is disclosed in Japanese Patent Unexamined Publication No. 57-100459. The fluororesin is a bad heat conductor, therefore it is desirable that a membrane thickness of the fluororesin be minimized so as to reduce the time for the HR surface to reach a predetermined temperature after the heating element is actuated. It is advisable that the membrane thickness be 20 μm or below in a distance from the nose of a protrusion of ruggedness of a membrane inner layer of the fluororesin to the surface of the membrane.

Further, the following is mentioned in Japanese Patent Unexamined Publication No. 60-213974. That is, since a heat conductivity of a heat-resisting resin of the surface layer is unsatisfactory, a heat energy from the heating element. Thus the HR surface, a heat response efficiency is weak and furthermore a heat loss is considerably extensive. When a membrane thickness of the surface layer is 40 μm to 50 μm, a difference in temperature between the heating element and the HR surface reaches 20° C. to 25° C. Accordingly, when much heat is taken away suddenly from the HR surface through copying incessantly, a heat supply from the heating element to the surface layer becomes insufficient temporarily, and thus HR peripheral temperature drops to cause a defective fixation. Further, in case much heat is taken away from a central portion of the HR surface and thus the surface temperature of the central portion drops temporarily through copying continuously on a narrow and small-sized recording paper, temperature of the heating element rises according to an action of the heat sensor and a heat supply to the HR peripheral surface is increased, therefore the surface temperature considerably rises on opposite end sides of HR. Accordingly, the surface temperature exceeds a heat-resisting temperature of the heat-resisting resin layer to shorten the lifetime, or when copying on a broad and large-sized recording paper after copying continuously on a small-sized one, a toner offset phenomenon arises on opposite end sides of the paper.

Further, Japanese Patent Unexamined Publication No. 56-159676 may be taken up as referring to a prior art example. A thickness of the surface layer has been specified at 30 μm or below. Then, from specifying the thickness of the surface layer at 30 μm or below, a heat supply is made from a roller mandrel at the nip zone, and as a result, temperature of the surface layer rises.

An apparatus of the aforementioned prior art which uses the preheater and rotates the fixing roller couple at high speed to fixation involves the problem that a large-sized construction is quite unavoidable with a fixing system comprising the preheater. Further, since the preheater must heat the recording paper from a non-print surface, in the case of high-speed double-side printing recording system where the non-print surface may not be present, the preheater cannot be provided. Consequently, when the fixing system is used in the state where the high-speed printing recording system is not provided with the preheater, a satisfactory fixing strength will not be obtainable.

Still further, a prior art in which the surface layer consisting of fluororesin is thinned in thickness without using the preheater is not so problematical when the number of sheets to print is small, however, when printing so much continuously, a quantity of heat moving from a mandrel on the lower layer to the surface layer increases from the surface layer having been thinned in thickness. Thus, when carrying out a fixation continuously, temperature of the HR mandrel suddenly drops, the HR surface temperature also drops correspondingly thereto, and a satisfactory fixing strength is not obtainable after all.

Meanwhile, a toner remains partly as a stain on the heat roll at the time of fixing operation. Consequently, a cleaning device for removing the stain is normally provided on the heat roll. Japanese Utility Model Publication No. 63-50669 may be taken up as referring to such prior art. The prior art then comprises a construction to wipe out a stain on the heat roll as moving a wiping belt from a let-off roller toward a take-up roller in the counter direction to that in which the heat roll rotates. The wiping belt consists of a felt 1 mm or so ordinarily in thickness. Further, Japanese Patent Unexamined Publication No. 57-118283 may be taken up as giving another prior art. This prior art comprises a construction wherein a wiping member is disposed in contact longitudinally of the rotating heat roll, wiping out a toner remaining on the heat roll. Then, the wiping member is formed of a coarse nonwoven fabric such as felt 3.2 to 12.7 mm thick or the like.

The aforementioned take-up type cleaning device is 1 mm thick, therefore the wiping belt is taken up so quickly, and hence the replacing work is required frequently. For the coarse construction, the cleaning device using a felt 3.2 to 12.7 mm in thickness has a disadvantage that a toner moved from the heat roll to the wiping member is capable of adhering again to the heat roll. Such problem is inherent not only in the cleaning device provided on the heat roll but also in a cleaning device provided on a back-up roll of the recording apparatus and a photosensitive member.

SUMMARY OF THE INVENTION

An object of this invention is to provide a fixing apparatus ensuring a satisfactory fixing strength despite carrying out a continuous fixation without using a preheater and a heater roll for use on the fixing apparatus.

Another object is to provide a fixing apparatus having a cleaning device superior in cleaning capacity.

A further object is to provide a recording apparatus capable of realizing stably a printing satisfactory in fixing strength, and is further to provide a recording apparatus provided with a cleaning device superior in cleaning capacity.

To attain the aforementioned objects, a fixing apparatus relating to this invention comprises a heat roll provided with a hollow cylindrical mandrel, a heat source disposed within the mandrel, a surface layer provided to cover a surface of the mandrel, a thickness of the surface layer being formed not to exceed the thickness to be determined by a square root of the product of a heat diffusion rate of the surface layer material and a nip time for a form to pass a nip zone described hereinlater, a thickness of the mandrel being formed not less than the thickness to be determined by a square root of the product of a heat diffusion rate of the mandrel material and one rotational period of the mandrel, a back-up roll paired with the heat roll, a nip zone formed at a portion where both the two rolls are opposite each other for fixing a toner to a recording paper passing through the opposite portion, a separator for separating the recording paper coming out of the nip zone and sticking to the heat roll surface from the heat roll surface, a cleaning device for removing a toner transferred to the heat roll from the recording paper. Here, the surface layer material is a fluororesin with the surface layer coming preferably at 40 μm or less in thickness. Then, the mandrel material is aluminum with the mandrel coming preferably at 6 mm or more in thickness.

In the aforementioned fixing apparatus, the separator is preferably a separating claw type disposed with a clearance against the heat roll surface. Here, the clearance is set preferably not to exceed the thickness of the recording paper, and is formed variably further according to the thickness of the recording paper. Then, the separating claw consists of a metal with a fluororesin layer provided preferably on the surface. Further, a gas nozzle for jetting a gas and thus separating the recording paper from the heat roll on the gas stream is provided preferably on a nose of the separating claw on the heat roll side.

In the aforementioned fixing apparatus, the cleaning device is provided with a wiping belt moved from a let-off roller toward a take-up roller and sliding a surface of the heat roller, a support member for supporting a sliding portion of the wiping belt and the heat roller, and a separating liquid feeder for feeding a separating liquid for enhancing a separation efficiency of the toner from the heat roll to the wiping belt, the wiping belt consisting of a heat-resisting synthetic paper with its thickness formed almost at 50 μm or below. Then, the support member is disposed slantingly so as to have the separating liquid feeder positioned upward, and a push member for pushing the wiping belt against the heat roll is provided preferably on an inclined lower end portion of the support member. Further, a resin having an affinity with the toner is mixed preferably in the wiping belt, and still the resin may be clear. Then, a weir for depressing a flow of the separating liquid is provided on the support member, and the weir is positioned preferably upper than the push member but lower than a separating liquid feed position which is the main position whereat the separating liquid is absorbed by the wiping belt. Further, a prewiping device is provided preferably upstream of the position whereat the wiping belt of the heat roller slides with the heat roller. Here, the prewiping belt of the prewiping device is taken up on the take-up roll together with the wiping belt, however, the prewiping belt consists preferably of a heat-resisting synthetic paper.

A heat roll for use on the fixing apparatus relating to this invention comprises a hollow cylindrical mandrel formed not less than the thickness to be determined by a square root of the product of a heat diffusion rate of the mandrel material and a one rotational period of the mandrel, and a surface layer formed not to exceed the thickness to be determined by a square root of the product of a heat diffusion rate of the surface layer material provided to cover a surface of the mandrel and a nip time whereat a paper passes the nip zone. Here, the surface layer material is a fluororesin, the surface layer is formed at 40 μm or less in thickness; the mandrel material is an aluminum, and the mandrel is formed preferably at 6 mm or more in thickness.

A recording apparatus relating to this invention comprises a heat roll provided with a developing station for obtaining a toner image not yet fixed on a fed recording paper, a hollow cylindrical mandrel, a heat source disposed within the mandrel, and a surface layer provided to cover a surface of the mandrel, a thickness of the surface layer being formed not to exceed the thickness to be determined by a square root of the product of a heat diffusion rate of the surface layer material and a nip time whereat a paper passes a nip zone to be described hereinlater, a thickness of the mandrel being formed not less than the thickness to be determined by a square root of the product of a heat diffusion rate of the mandrel material and one rotational period of the mandrel, a back-up roll paired with the heat roll, a nip zone formed at a portion where both the two rolls are opposite to each other for fixing a toner to a recording paper fed from the developing station and passing through the opposite portion, a fixing apparatus having a separator for separating the recording paper coming out of the nip zone and sticking to a surface of the heat roll from the heat roll surface, and a cleaning device for removing the toner transferred to the heat roll from the recording paper. Here, with reference to the heat roll of the fixing apparatus, the surface layer material is a fluororesin, the surface layer is formed at 40 μm or less in thickness, and the mandrel material is an aluminum, the mandrel is formed preferably at 6 mm or more in thickness.

The thinned HR surface layer functions as increasing a quantity of heat fed from the mandrel to the surface layer during the period of time when the paper passes the nip zone. As a result, a quantity of heat flowing into the toner from the surface layer increases, therefore a fixing strength can be enhanced. In this case, while the mandrel temperature drops, a heat capacity of the mandrel will be enhanced by optimizing a thickness of the mandrel, further a temperature fluctuation can be minimized, therefore even from carrying out a semiperpetual continuous fixation through continuous printing, a satisfactory fixing strength can be maintained stably.

According to the thinned surface layer of HR in the fixing system of the present invention, a quantity of heat fed to the toner is increased, therefore a thermal reply efficiency will be enhanced. If only the surface layer is thinned, then the effect functions to intensify the HR temperature drop, and the time interval for ON/OFF operation will be shortened in a control of the heating element. Accordingly, a high precision temperature controller will be necessary. However, as described above, this invention comprises optimizing a thickness of the mandrel so as to cover the disadvantage inevitable from thinning the surface layer, therefore such a high precision temperature controller is not particularly required.

Then, the recording apparatus relating to this invention comprises a developing system provided at least with a photosensitive member, a developing device, a transfer device, a cleaning device for the photosensitive member, a fixing system provided at least with a heat roll, a back-up roll, a cleaning device for the heat roll, a cleaning device for the back-up roll, and an ultrafine fibrous sheet member for forming a wiping member of at least one cleaning device of those for the heat roll and the back-up roll.

The wiping member is preferably a woven fabric or nonwoven fabric formed of ultrafine fibers. Further, the wiping member is preferably a fabric woven by a fiber group disposing a plurality of the ultrafine fibers almost in parallel. Still further, the ultrafine fiber is preferably at 20 μm or less or particularly at 4 μm or less in the strand size.

The wiping member for the cleaning device used by this invention is that for which ultrafine fibers are formed into a sheet, therefore the number of constituent fibers per unit area is extremely large, and thus lots of voids are formed between the fibers.

Accordingly, in case such sheet member is used as the wiping member, a considerable number of fibers will come in contact with a wiped member such as heat roll or the like as compared with the prior art, therefore the toner remaining on the wiping member can be wiped out securely. The wiping operation is realized such that the wiping member is pushed against the wiped member by a push member, and the fibers in contact with the wiped member remove the toner stuck thereon. The removed toner is taken into a multiplicity of voids formed between the fibers, and thus the toner will never stick again to the wiped member.

As described hereinbefore, a use of the cleaning device may lead to an advantage that a toner remaining on the wiped member such as heat roll, back-up roll, photosensitive member or the like of the recording apparatus is removed securely, the wiped-out toner is taken and so held securely into the wiping member, and thus is prevented from resticking to the wiped member, therefore a stainless and clear recording may be realized.

DETAILED DESCRIPTION OF THE PREFERRED EMBODIMENTS

Embodiment 1

Figure 1:
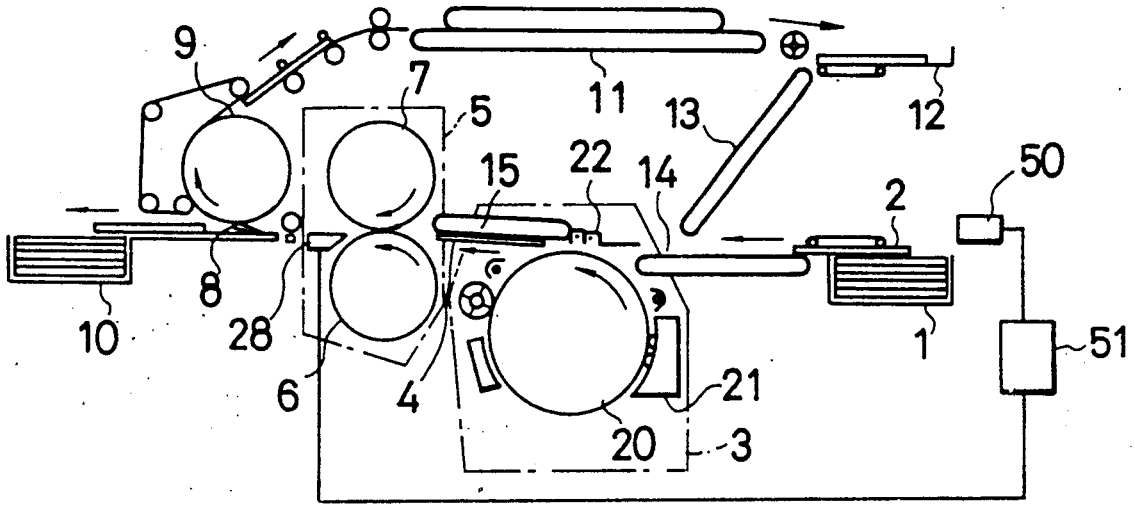
FIG. 1 is a sectional view of a double-side recording apparatus on which a fixing apparatus of this invention is mounted.

One preferred embodiment of this invention will now be described with reference to FIGS. 1. FIG. 1 is a sectional view showing a printing process of a double-side recording apparatus on which a fixing apparatus of this invention is mounted. Here, a numeral 1 denotes a feed paper hopper, 2 denotes a recording paper, 3 denotes a developing station, 4 denotes a first side of the recording paper, 5 denotes a fixing apparatus, 6 denotes a heat roll, 7 denotes a back-up roll, 8 denotes a separating claw, 9 denotes an inverter roll, 10 denotes a discharge paper stacker, 11 denotes a return passage, 12 denotes an inversion stacker, 13 denotes a confluent passage; 14 denotes a confluence, 15 denotes a second side of the recording paper, 20 denotes a photosensitive member, 21 denotes a developing machine, and 22 denotes a transfer press. In this invention, the fixing apparatus 5 employs a heat roll fixing construction using the heat roll 6 and the back-up roll 7.

The recording paper 2 stored in the feed paper hopper 1 is carried to the developing station 3 comprising at least the photosensitive member 20, the developing machine 21, the transfer press 22, where a toner image not yet fixed is prepared on a first side of the recording paper 2. Next, the recording paper 2 with the unfixed toner image is carried to the fixing apparatus 5 to be heated, thus the toner image on the first side 4 is fixed and stuck to the recording paper 2. After fixing an image on the first side 4, the recording paper 2 reaches a shunt consisting of the separating claw 8, and is shunted upward when set to a second side print mode, then carried to the inverter roll 9 side. The separating claw 8 changes its position vertically, thereby functioning as the shunt. In the illustration, a position of the separating claw comes on a lower side, which indicates that a shunt operation will be made to the inverter roll 9 side. When the separating claw 8 is positioned upward, the shunt operation will be made to the discharge paper stacker 10 side. Next, the recording paper 2 is sent to the return passage 11 by the inverter roller 9. The recording paper 2 is once stored in the inversion stacker 12, then discharged to the confluent passage 13 before the next recording paper 2 reaches the inversion stacker 12, and reaches the confluence 14. The recording paper 2 having passed the confluence 14 gets on the same passage as in the case it was discharged first from the feed paper hopper 1, and then reaches the developing station 3 again. In this case, the first side 4 already printed faces upward. Accordingly, in this case, a toner image not yet fixed is prepared on the second side 15 of the recording paper 2 in the developing station 3. Next, a fixation to the second side 15 is carried out as in the case of fixation to the first side 4. The separating claw 8 is changed to an upper position in this case, the recording paper 2 has both the first and second sides printed and is then discharged to the discharge paper stacker 10. The above has referred to a basic operation and construction of the double-side recording apparatus with reference particularly to movement of one recording paper. Practically speaking the operation is carried out continuously. Then, in case a printing is made only on the first side, the separating claw 8 is positioned upward when the recording paper 2 reaches the separating claw 8 the first, time through and is discharged to the discharge paper stacker 10 straight.

Figure 2:
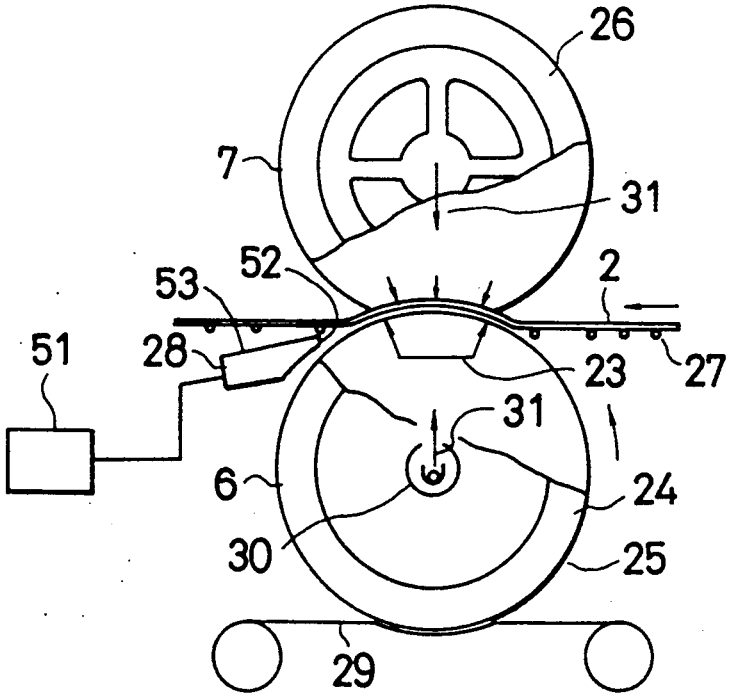
FIG. 2 is a sectional view of the fixing apparatus relating to this invention.

FIG. 2 is a sectional view of a fixing apparatus of this invention. A numeral 23 denotes a nip zone, 24 denotes a mandrel, 25 denotes a surface layer, 26 denotes a silicone rubber layer, 27 denotes a toner, 28 denotes a separator, 29 denotes a cleaning device, 30 denotes a heater lamp working as a heat source, and 31 denotes a pushing force. The heat roll 6 comprises the mandrel 24 which is an aluminum hollow cylinder and the fluororesin surface layer 25 provided on the surface thereof, and the heater lamp 30 (halogen lamp) is disposed centrally thereof. The back-up roll 7 comprises an aluminum cylinder and the outside silicone rubber layer 26. The heat roll 6 and the back-up roll 7 are opposite to each other with the pushing force 31 working therebetween, and the contact surface is formed by the silicone rubber layer 26 coming to an elastic deformation. The contact surface is called the nip zone 23. When the recording paper 2 on which the unfixed toner 27 is imaged passes the nip zone 23 between the heated heat roll 6 and the back-up roll 7, the toner 7 is melted and sticks to the recording paper 2. This process is called fixation. The separator 28 is used for separating the recording paper 2 stuck to the surface of the heat roll 6 at the nip zone 23 from the heat roll 6. In this embodiment, a non-contact peeling system is employed, which will be described in detail hereinlater. Most of the toner 27 is fused to the recording paper 2 at the nip zone. However, some toner 27 may be transferred to the heat roll 6. The toner 27 transferred to the heat roll 6 is retransferred to the recording paper 2 for the next fixation and thus is capable of causing an erroneous print, and hence the cleaning device 29 is provided therefor. The cleaning device 29 then functions to wipe off the toner 27 transferred to the heat roll 6. A detailed description will be made thereof hereinlater.

Then, in the fixing apparatus of this embodiment, both the heat roll 6 and the back-up roll 7 are 100 mm in diameter, and a time (nip time) for one point of the paper to pass the nip zone is 14 ms.

Figure 3:
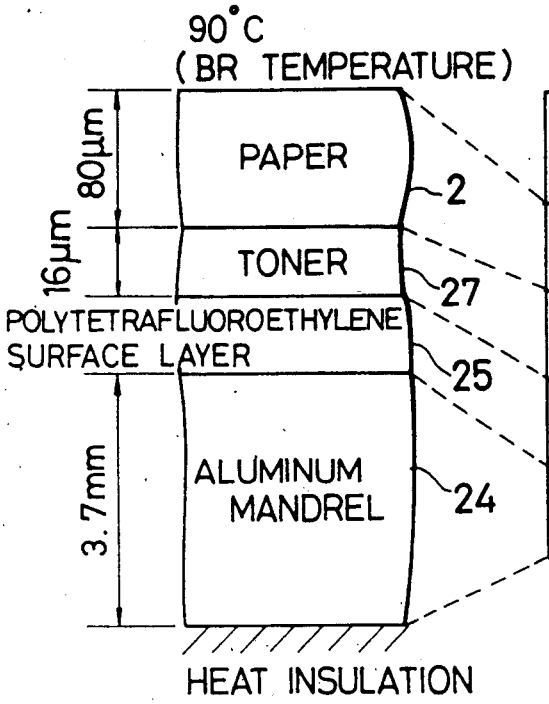
FIG. 3 is a view indicating a model used for thickness calculation.

As shown in FIG. 1 and FIG. 2, in the fixing apparatus of this embodiment, the toner 27 is heated only at the nip zone 23 formed between the heat roll 6 and the back-up roll 7. To attain the subject matter, it is necessary that a quantity of heat flowing into the toner 27 from the heat roll 6 be increased properly. Thus, a heat flow mechanism in the heat roll 6 at the time of fixation has been obtained. For examination, a non-steady temperature distribution calculation according to a finite element method was employed. FIG. 3 is a view showing a model used for the calculation. The model is a 4-layer dimensional model consisting of the aluminum mandrel 24, the Teflon surface layer 25, the toner 27 and the recording paper (form) 2. For convenience' sake, specific matters are mentioned here, however, the matters indicated here are those of being specified by the heat conductivity and the heat diffusion rate shown in FIG. 3. Accordingly, this is not to specify matters essentially. For example, if matters are of a heat conductivity and a heat diffusion rate, then equal calculation results will be obtainable irrespective of the kind of matters.

Here, the non-steady temperature distribution calculation according to the finite element method will be described. The following thermal conduction equation was solved according to the finite element method:

$$\frac{\partial T}{\partial t} = a\frac{\partial^2 T}{\partial x^2}$$

where T represents a temperature, t represents a time and x represents a position. In the finite element method, a solution is obtainable through the temperature specified by the position and the time. In the concrete, it is indicated by the temperature at a time step (time) and a node (position). A general purpose program is used for the calculation.

The temperature indicated in this specification has a solution by the calculation according to the finite element method used straight therefor. Then, a heat flux is that for which a value obtained through dividing the difference between temperature at the interface and temperature of the next node by a distance between the nodes is multiplied by a heat conductivity. With the heat flux flowing into the toner from the surface layer exemplified for the description, temperature and position of an interface of the surface layer and the toner will be indicated by $T_1$, $x_1$ respectively, and temperature and position of the node nearest to the interface will be indicated by $T_2$, $x_2$ respectively. Further, with a heat conductivity of the toner as $\lambda$ and the heat flux as q, the heat flux will be defined by the following equation:

$$q = \lambda\frac{T_1 - T_2}{x_1 - x_2}$$

In the actual calculation, 2 $\mu$m was used for $x_1 - x_2$.

Figure 4:
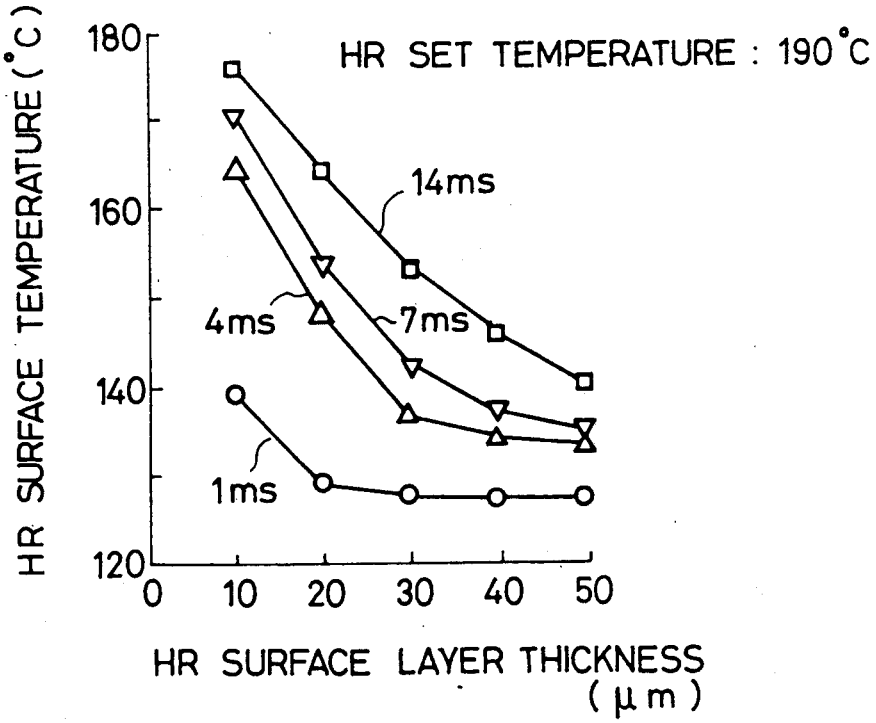
FIG. 4 is a view showing a relation between a surface layer thickness and an HR surface temperature in a nip zone.

FIG. 4 is a view showing a relation between the surface layer thickness and the surface temperature of a heat roll (HR) in the nip zone at the time of fixation which are obtained through the above calculation. The parameter is a time after the form is nipped at a front end of the nip zone. Accordingly, 1 ms indicates the initial period of a nip time, 4 ms and 7 ms indicate the middle periods, and 14 ms indicates the latter period. The indicated HR temperature is a set temperature before fixation. The reason why the HR temperature at each time is lower than the HR set temperature (190 ° C.) is that heat is soon absorbed by the form whenever the form is nipped in the nip zone. Further, the thinner the HR surface layer is, the higher the HR surface temperature becomes, because heat is fed from the inner layer mandrel to the surface layer quicker where the surface layer is thinner in thickness. As described above, the surface temperature increases according as the surface layer is thin irrespective of time. Normally, a fixing strength is enhanced 5 to 10% by increasing the HR set temperature before fixation by 10° C. Accordingly, an enhancement of the fixing strength is expected by thinning the surface layer.

Figure 5:
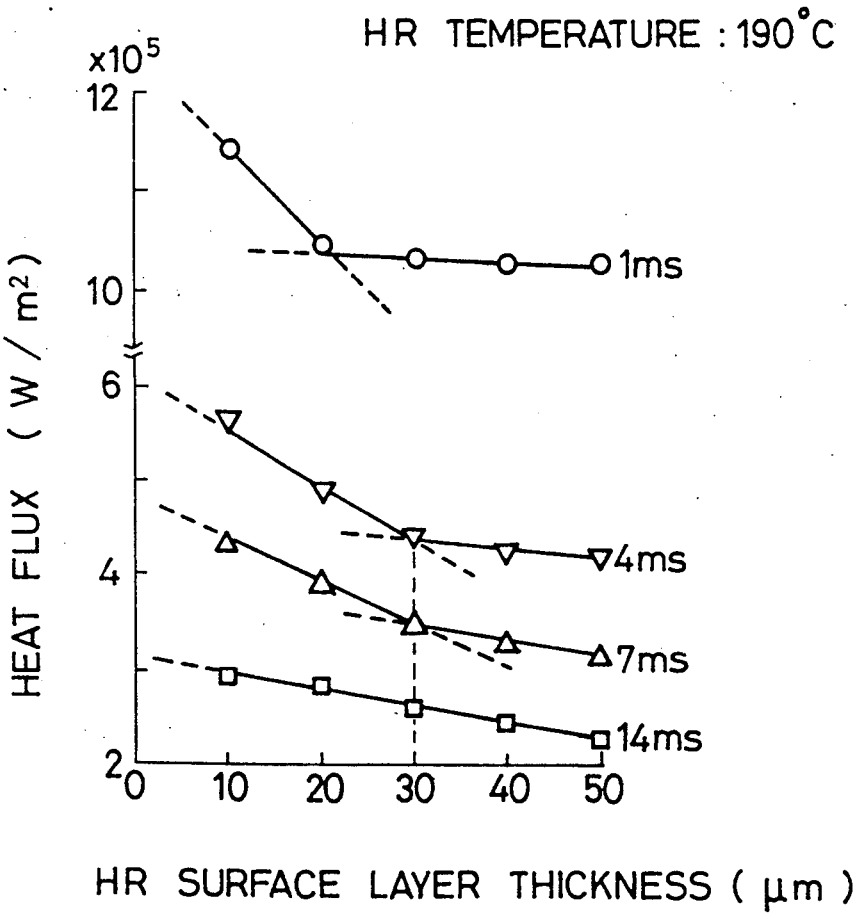
FIG. 5 is a view showing a relation between a surface layer thickness and a heat flux to a toner.

Next, a decision of an optimal thickness of the surface layer will be tried from taking a heat carrying mechanism into consideration. FIG. 5 is a view showing a relation between the surface layer thickness obtained through the aforementioned calculation and a heat flux (quantity of the incoming heat per unit time and unit area) coming from HR into a toner. Parameter and others are same as in the case of FIG. 4. A heat flux from the surface layer to the toner tends to increase according as the surface layer is thin, and at 1 ms which is the initial period of nip time, it rapidly increases at or below 20 $\mu$m in the surface layer thickness. Further, at 4 ms and 7 ms which are the middle periods of nip time, it also rapidly increases at or below 30 $\mu$m in the surface layer thickness. Then, the reason why a value of the heat flux gets small as a whole with the lapse of time is that a difference in temperature between the toner and the surface layer gets gradually small.

Figure 6:
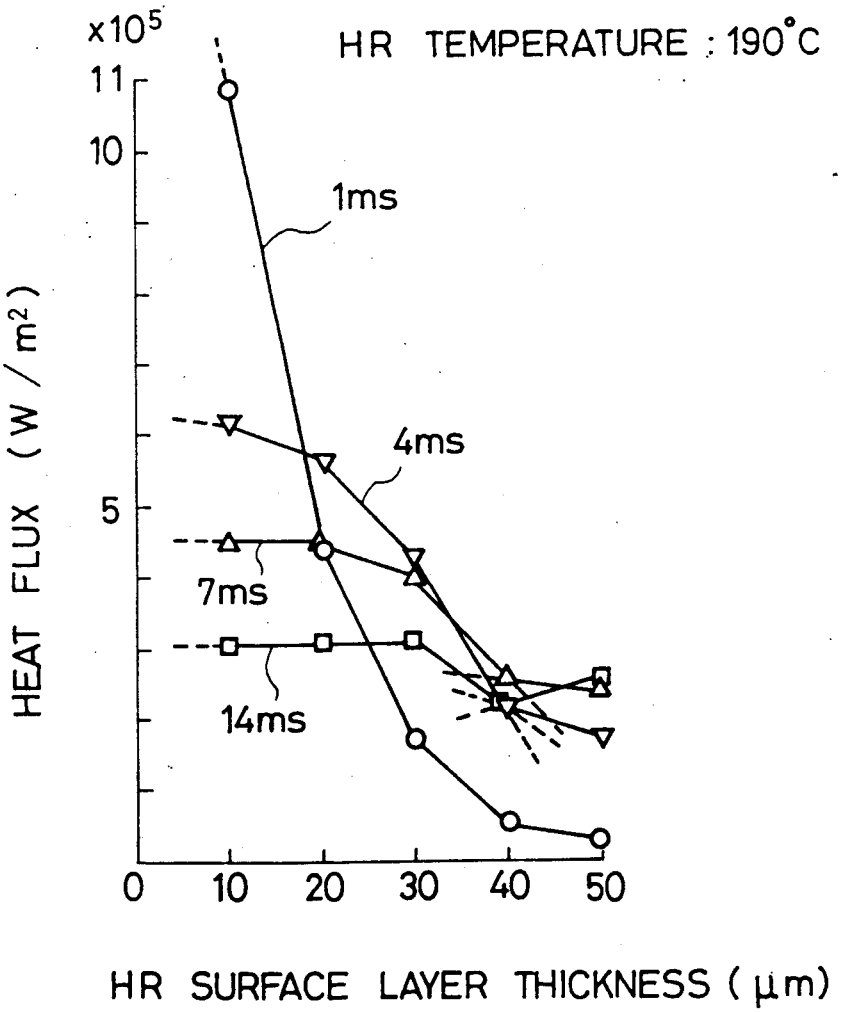
FIG. 6 is a view showing a relation between a surface layer and a heat flux to a surface layer.

An attempt has been made to further clarify the phenomenon. FIG. 6 is a view showing a relation between the surface layer thickness obtained through the calculation given hereinabove and the heat flux from the aluminum mandrel to the surface layer. Parameter and others are same as in the case of FIG. 4. A quantity of heat flowing from the aluminum mandrel into the surface layer is large when the surface layer is thin. The inclination is particularly striking in the initial period of nip time (1 ms). During the period of time, it is understood that the situation is nearly an adiabatic state in the range (40 to 50 $\mu$m) where the surface layer is thick. The heat flux then gradually increases with the lapse of time, however, an absolute value is low as compared with the range (10 to 30 $\mu$m) where the surface layer is thin. A boundary of ranges where the surface layer is thin and thick is the point whereat the surface layer thickness is about 40 $\mu$m, and with the 40 $\mu$m as boundary, a change of the heat flux with reference to the surface layer thickness is discontinuous. The reason is that an influence of the heat flux to a fixed toner which is generated on the HR surface is easy to be exerted on the aluminum mandrel during the nip time in the range where the surface layer is thin, but the influence is hard to be exerted to the contrary in the thick range, and the boundary exists at 40 $\mu$m in the surface layer thickness. It may indicate likewise that heat from the aluminum mandrel is fed too much during the period of nip time in the range coming not more than 40 $\mu$m in the surface layer thickness, but heat from the aluminum mandrel is fed less in the range coming thicker than that. From the result above, it can be understood why a quantity of heat flowing into the toner increases under specific surface layer thicknesses (20 $\mu$m at 1 ms and 30 $\mu$m at 4 ms and 7 ms) in FIG. 5.

Now, a great enhancement of the fixing strength may be expected in the range wherein heat from the aluminum mandrel increases much (surface layer thickness being at about 40 $\mu$m or below) during the period of nip time. Accordingly, the surface layer thickness may come preferably within the range (40 $\mu$m or below). Then, the range wherein a heat flux from the surface layer to the toner is large (surface layer thickness being at 30 $\mu$m or below) is preferable during the middle period of nip time. Still further, the range wherein a heat flux from the surface layer to the toner is large (surface layer thickness being at 20 μm or below) is preferable during the initial period of nip time.

Figure 7:
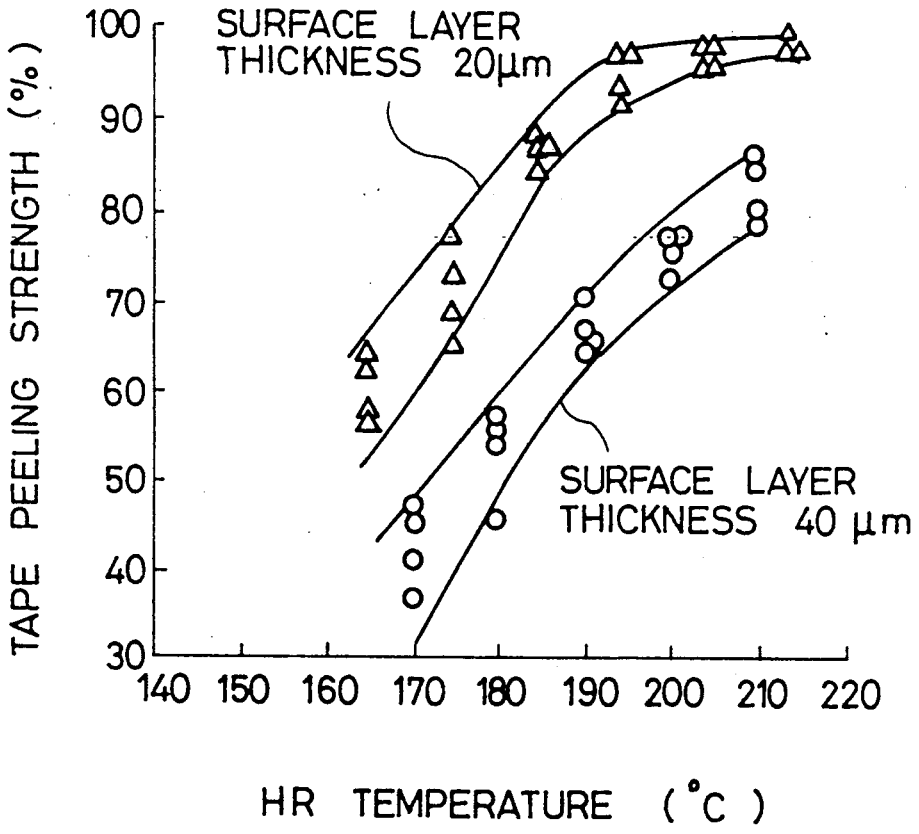
FIG. 7 is a view showing a relation between an HR temperature and a fixing strength.
Figure 8:
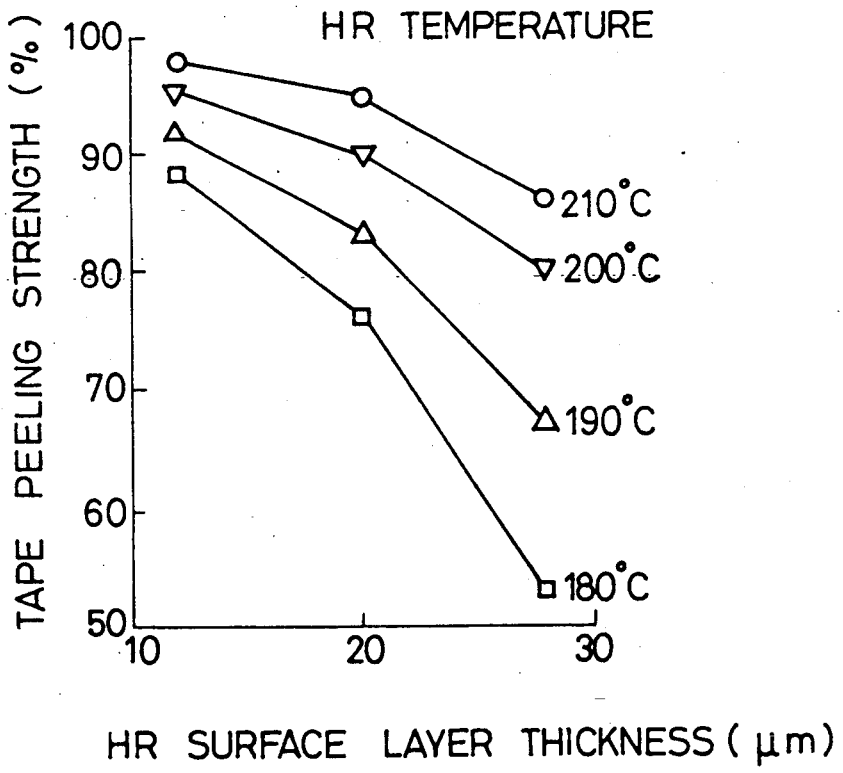
FIG. 8 is a view showing a relation between a surface layer thickness and a fixing strength.

To confirm the calculation result, a test was carried out under the same conditions as the calculation. FIG. 7 is a view showing a relation between a set temperature before fixation (HR temperature) under the condition 20 μm and 40 μm in the surface layer thickness and a fixing strength. The fixing strength was given in a tape peeling strength. Then, an adhesive tape was applied once to a fixed image and peeled off, and thus the tape peeling strength was defined by a ratio of reflection density between the images before applying and after peeling. Accordingly, the larger the value is, the higher the fixing strength becomes. With the set temperature before fixation (HR temperature) as a parameter, FIG. 8 shows a relation between the surface layer thickness and the fixing strength. The smaller the surface layer thickness is, the greather the tape peeling strength becomes.

Figure 9:
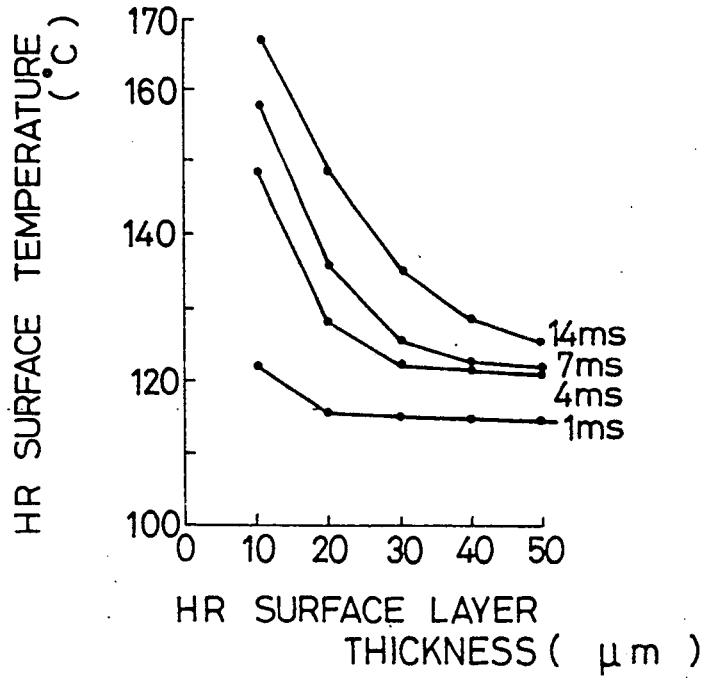
FIG. 9 is a view corresponding to FIG. 4 representing another example.
Figure 10:
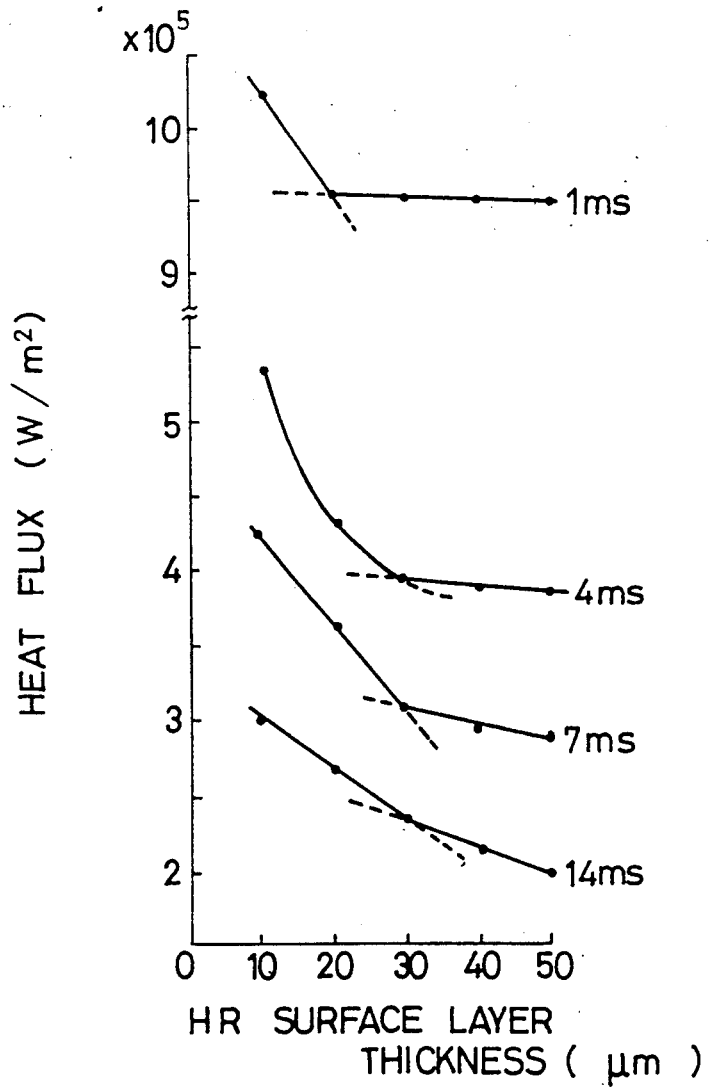
FIG. 10 is a view corresponding to FIG. 5 representing another example.
Figure 11:
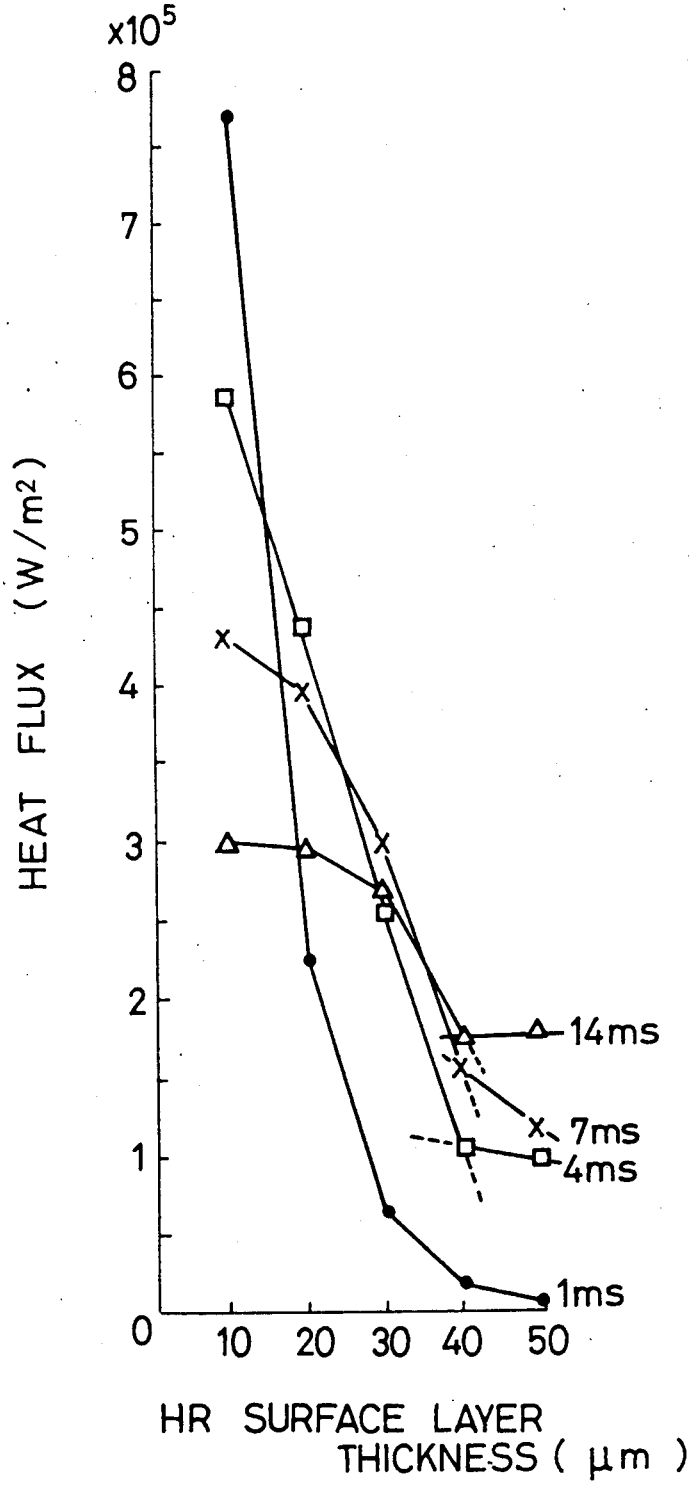
FIG. 11 is a view corresponding to FIG. 6 representing another example.
Figure 12:
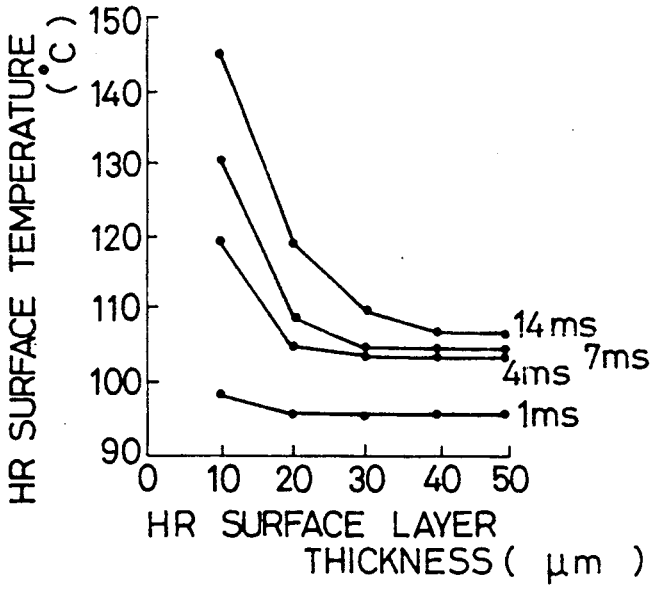
FIG. 12 is a view corresponding to FIG. 4 representing the other example.
Figure 13:
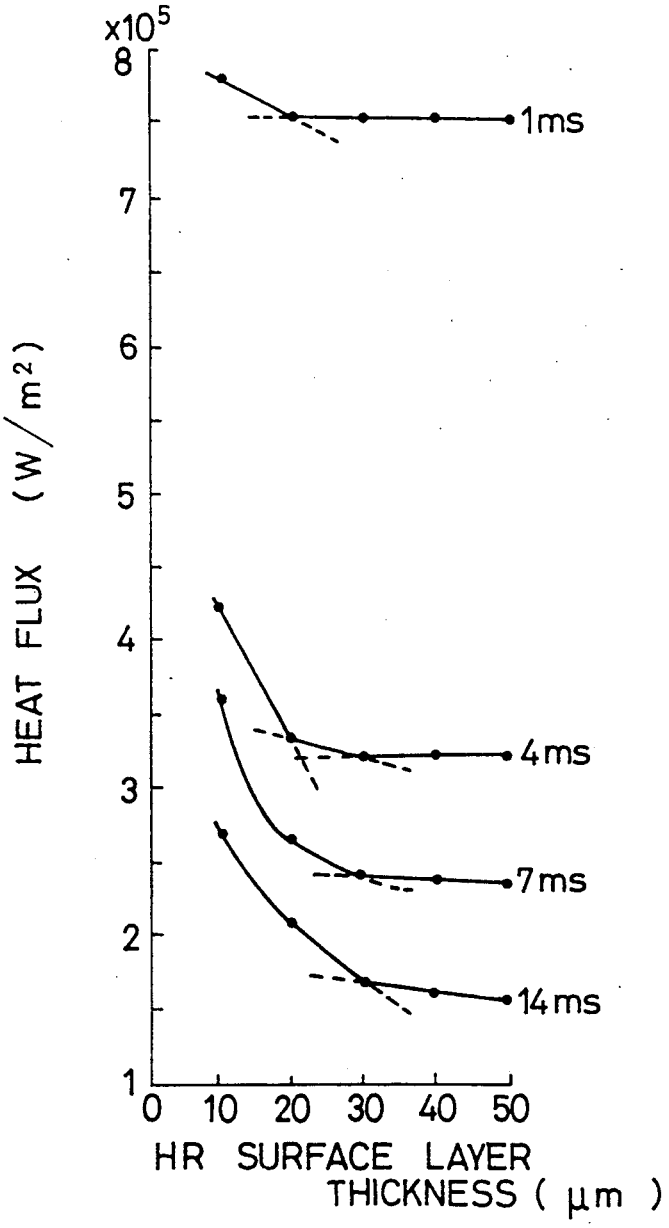
FIG. 13 is a view corresponding to FIG. 5 representing the other example.
Figure 14:
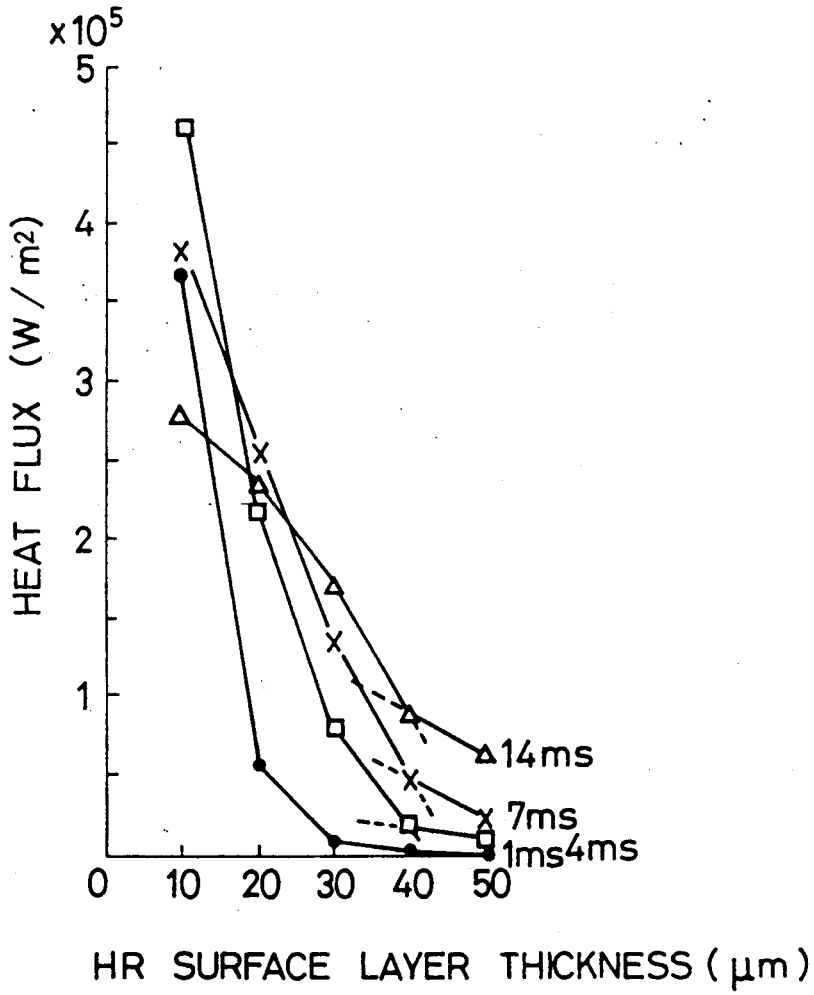
FIG. 14 is a view corresponding to FIG. 6 representing the other example.

The surface layer thickness is indicated concretely above as being a fluororesin exemplified as a surface layer material for convenience' sake, and produces the calculation results corresponding to FIGS. 4 to 6. Other surface layer materials different in heat diffusion rate, will be shown in FIG. 9 to FIG. 14. FIG. 9 to FIG. 11 refer to the case where the surface layer material is $6.41\times10^{-8}$ m²/s in heat diffusion rate and the mandrel is aluminum, and FIGS. 12 to 14 refer to the case where the surface layer material is $2.85\times10^{-8}$ m²/s in heat diffusion rate and the mandrel is aluminum. A conclusion similar basically to FIG. 4 and FIG. 6 is also obtainable from the calculation results. Further, with the range where a quantity of heat coming from the mandrel (40 μm or below in the fluororesin) as $l_1$, the heat diffusion rate of a surface layer material as $a_s$, the nip time as tn, these examples may generally lead to:

$$l_1 = \sqrt{a_s t_n} \tag{1}$$

Further, in the middle period of nip time, if the range where a heat flux from the surface layer to the tone is large (30 μm or below in Teflon) is $l_2$, then there is a tendency toward:

$$l_2 = \tfrac{3}{4}\sqrt{a_s t_n} \tag{2}$$

Still further, if the range where a heat flux from the surface layer to the tone is large (20 μm or below in Teflon) in the initial period of nip time is $l_3$, then there is also a tendency toward:

$$l_3 = \tfrac{1}{2}\sqrt{a_s t_n} \tag{3}$$

If Eqs. (1) to (3) are calculated by means of the heat diffusion rate of Teflon shown in FIG. 3:

$$l_1=(1.11\times10^{-7}\times10^{12}\times14.6\times10^{-3})^{\frac{1}{2}}=40.3\ (\mu m)$$

$$l_2=\tfrac{3}{4}\times(1.11\times10^{-7}\times10^{12}\times14.6\times10^{-3})^{\frac{1}{2}}=30.2\ (\mu m)$$

$$l_3=\tfrac{1}{2}\times(1.11\times10^{-7}\times10^{12}\times14.6\times10^{-3})^{\frac{1}{2}}=20.1\ (\mu m)$$

thus it is understood that these coincide well with the calculation results of FIG. 5 and FIG. 6. This may exemplify a generality of Eqs. (1) to (3), however, a similar result is obtained from using other matters. Accordingly, the surface layer is preferable at $\sqrt{a_s t_n}$ or below in thickness. It is then preferable at $\tfrac{3}{4}\sqrt{a_s t_n}$, and further at $\tfrac{1}{2}\sqrt{a_s t_n}$ or below.

Meanwhile, the mandrel has a heat fed from a heater lamp, stores it once therein, and feeds the heat to the surface layer as a necessary fixing energy. In other words, it functions as a secondary heat source.

The HR of this invention having the aforementioned surface layer thickness has a large quantity of heat coming from the mandrel in the nip time, therefore when the mandrel is used as a secondary heat source, a stability of temperature at an interface of the mandrel and the surface layer must be kept high. That is, in case temperature at the interface is unstable, when fixing the recording paper one sheet, and then two sheets and three continuously, the first sheet can be fixed, however, the ensuing sheets cannot be fixed or fixed limitedly in number, but several thousand or several ten thousand sheets are no more available for semiperpetual fixation.

Figure 15:
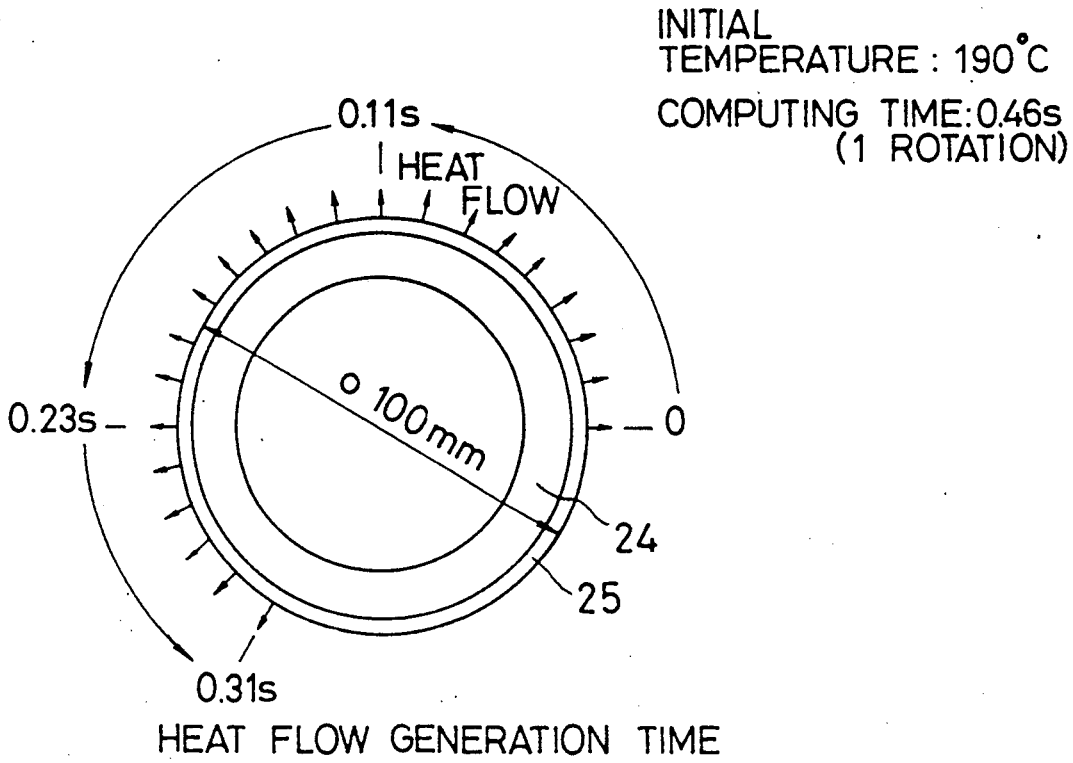
FIG. 15 is a view showing a model used for calculation.

Next, a stability of temperature at an interface of the mandrel and the surface layer was examined. The nonsteady temperature distribution calculation according to the finite element method was also employed likewise. FIG. 15 is a view showing a model used for the calculation. The model is a two-dimensional model with the aluminum mandrel 24 and the Teflon surface layer 25 built up in doughnut. To simulate rotations of HR, heat fluxes flowing outwardly from the HR surface were generated successively. This corresponds to a quantity of heat required for fixation. In the calculation, the range comes in 210 mm, or A4-sized paper in transverse direction. A heat property value used therefor is same as the value shown in FIG. 3. As in the case of FIG. 3, a specific name of matter is mentioned for convenience' sake in the above description, however, the matter is specified according to a heat conductivity and a heat diffusion rate, and thus the name of matter is not to be fixed specially.

Figure 16:
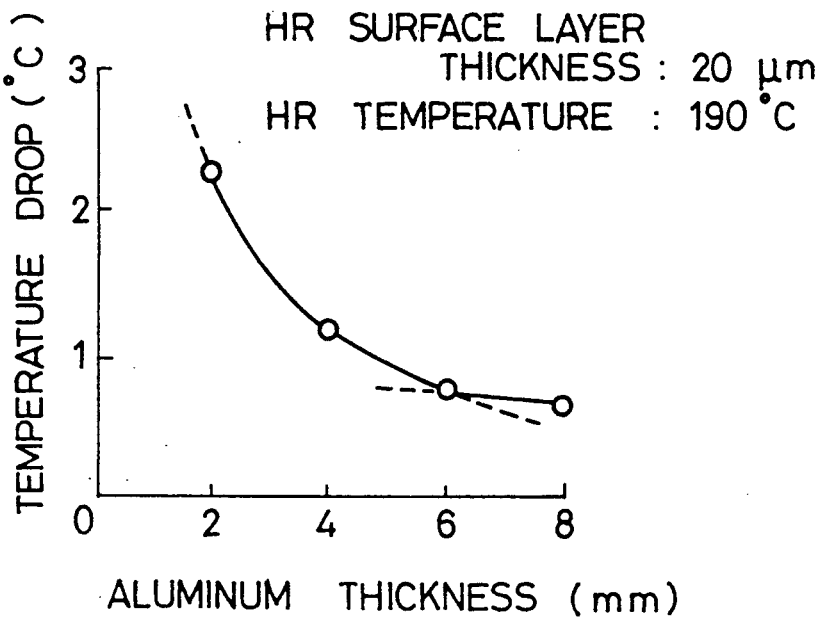
FIG. 16 is a view showing a relation between a mandrel thickness and a temperature drop.

FIG. 16 indicates a difference (temperature drop) between temperature at an interface of the aluminum mandrel and the surface layer after fixing one page and immediately before fixing the second page and initial set temperature at a circumferential position corresponding to a heat flow generated time 0. Here, the time required after fixing one page and immediately before fixing the second page at a circumferential position corresponding to the heat flow generated time 0 is called fixing period. Further, if expressed in conformity with phenomenon, the fixing period may refer to the time required for the position on HR whereat a front end of the recording paper comes in contact with HR to meet the recording paper next. Accordingly, when an HR circumferential length is shorter than the length of form in the direction where it is carried, the fixing period is equal to a rotational period of the HR. On the contrary, that is, even in case the HR circumferential length is longer than the form length, a minimum value of the fixing period becomes equal to the rotational period, therefore this invention is specified by the rotational period. In the calculation, a feed paper period is equal to the time required for the HR to rotate one turn, namely the rotational period. The thicker the aluminum mandrel is, the less temperature drop becomes, thus increasing stability. Then, the temperature drop becomes almost constant at the mandrel thickness being 6 mm. The reason is that an influence of the heat flow generated on the HR surface for fixation exerts as far as 6 mm internally of the aluminum mandrel at one rotational period. Accordingly, the temperature drop becomes almost constant at the mandrel thickness being 6 mm or over. As a result, the aluminum mandrel may preferably be 6 mm or more in thickness. Under this condition temperature will drop about 0.8° C. a page, therefore if a control width against temperature fluctuation during continuous feeding is estimated at, for example, 10° C., then the form may be printed as many as 12 pages or so without a lighting of the heater lamp 30. That is, heat will be fed to the mandrel or a secondary heat source from the heater lamp 30 while printing the 12 pages. In this case, however, how quickly to feed the heat to the point 6 mm in thickness will be problematical. When the mandrel thickness is increased more than that, there arises a time required for transferring heat from the heater lamp 30 to the aforementioned 6 mm point within the aluminum mandrel. That is, the aluminum mandrel functions as a thermal resistance for transferring heat from the heater lamp 30 to the 6 mm point. If the mandrel is too thick, then a time is required for the heat roll surface temperature to rise to a desired value from lighting of the heater lamp 30, exceeds one rotational period. Accordingly, an answer delay is unavoidable in the heat roll temperature control, and thus a heat roll temperature is capable of fluctuating around a desired value. If the aluminum mandrel thickness is 6 mm, then the time will be 0. Accordingly, the aluminum mandrel thickness may preferably be 6 mm.

A description has been given as above with the specific matter (aluminum) and conditions exemplified therefor, however, more generally, if a heat diffusion rate of the mandrel material is $a_i$, a rotational period is $t_p$, then a thickness L of the mandrel on which an influence of the heat flow due to fixation exerts at one rotational period will be:

$$L = \sqrt{a_i t_p} \tag{4}$$

Figure 17:
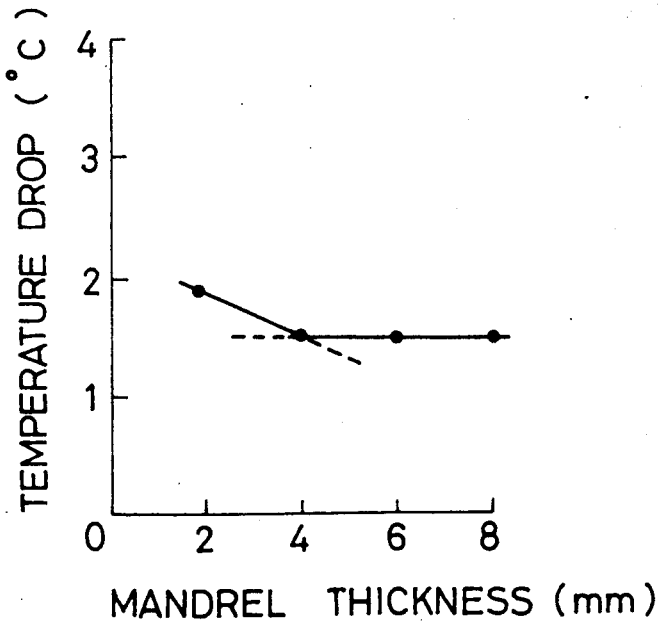
FIG. 17 is a view corresponding to FIG. 16 representing another example.

From calculating Eq. (4) by means of the aluminum heat diffusion rate shown in FIG. 3:

$$L = (8.15 \times 10^{-5} \times 10^6 \times 0.46)^{\frac{1}{2}} = 6.12 \text{ (mm)}$$

which coincides well with the calculation result of FIG. 16. This is so exemplified as to indicate a generality of Eq. (4), however, a similar effect is obtainable from using another material. FIG. 17 is a view corresponding to FIG. 16 which is obtained through calculating likewise with SUS (heat diffusion rate being $4.44 \times 10^{-6}$ $m^2/s$) replaced for the mandrel. Accordingly, the mandrel thickness will be desired at $\sqrt{a_i t_p}$ or over, but preferably at $\sqrt{a_i t_p}$.

A relation between the aluminum mandrel thickness and the aforementioned answer delay will now be examined. A problem to arise from such answer delay is avoidable to some extent from setting a lower bound value of permissible heat roll temperature somewhat higher and an upper bound value somewhat lower. For example, with a control width against temperature fluctuation as 0 and an actual temperature fluctuation as 10° C., an answer delay for 12 pages of the recording paper is permissible in conformity with this embodiment. From using Eq. (4) in this case:

$$L = (8.15 \times 10^{-5} \times 10^6 \times 0.46 \times)^{\frac{1}{2}} = 21.2 \text{ i-}$$

It the temperature control width is zero, then the problem due to answer delay will not be revealed as far as 21.2 mm in the mandrel thickness.

According to the above-described embodiment, an advantage is such that an auxiliary preheating is not required in addition to the heat roll and the back-up roll, and further a high fixing strength is obtainable stably for semiperpetual and continuous feed paper.

Embodiment 2

Another embodiment will be described with reference to FIG. 2. FIG. 2 is a sectional view of the fixing apparatus of this invention which has been described in Embodiment 1. The separator 28 is used for peeling a form off the HR, and is called usually a separating claw. In the fixing apparatus given in Embodiment 1, the surface layer 25 is thin as described, therefore when the separator 28 is brought into contact with the HR 6, the surface layer 25 is capable of being damaged. Even in case it is not damaged, a wear of the portion whereat the separator 28 comes in contact therewith is accelerated, and a lifetime of the HR 6 is considerably shortened. Therefore, in this embodiment, a clearance is provided between the separator 28 and the HR 6. The clearance is then set not longer than the thickness of the recording paper 2 to print so as to remove the recording paper thoroughly. According to this embodiment described as above, since the clearance is provided between the separator 28 and the HR 6, a lifetime of the HR 6 will never be shortened for the wear caused on the HR 6 by the separator 28.

Embodiment 3

A variant of Embodiment 2 will be described with reference to FIG. 2 and FIG. 1. A clearance between the HR 6 and the separator 28 shown in FIG. 2 is set not longer than the thickness of the recording paper 2, however, there may be a case where a thin sheet 80 μm in thickness of the recording paper is printed in the recording apparatus, therefore the clearance is set not longer than 80 μm. If the HR 6 happens to operate eccentrically, then the clearance set such small is capable of causing the separator 28 to come in contact with the HR 6. To decrease a probability of the occurrence, the clearance is expanded at the time of printing in this embodiment. To control the clearance, a recording paper thickness detector 50 is provided on the feed paper hopper 1, as shown in FIG. 1, in the recording apparatus, and a clearance between the separator 28 and the HR 6 is set on a control signal from a clearance control unit 51 according to the detection signal. According to this embodiment described above, the clearance between the HR 6 and the separator 28 is set according to the recording paper thickness, and thus the clearance can be enlarged when the recording paper is thick, therefore a probability of the separator 28 coming in contact with the HR 6 is decreased, and a lifetime of the HR 6 can be prolonged.

Embodiment 4

Another embodiment will be described with reference to FIG. 2. In Embodiments 2 and 3, there is still a slight chance that the separator 28 comes in contact with the HR 6 due to eccentricity of the HR 6 or other cause. In this embodiment, the clearance between the separator 28 and the HR 6 is set with a tolerance against a secular change in size such as eccentricity of the HR 6 or the like irrespective of thickness of the recording paper 2. In the concrete, the clearance is set at 1 mm. Further, to eliminate a defective separation of the recording paper 2, a gas nozzle 52 is provided on the separating claw so as to generate an air stream creeping along the surface of the HR 6 from a nose (on nip zone side) of the separating claw 28 instantaneously with a front end of the recording paper 2 passing the nip zone 23. The front end of the recording paper 2 is fanned by the air stream, and is separated securely from the HR 6. According to this embodiment described above, there is a sufficient gap present between the HR 6 and the separator 28, therefore a lifetime of the HR 6 will never be shortened, and since a separation is effected by means of an air stream, the recording paper 2 can be separated securely from the HR 6.

Embodiment 5

The separator 28 of the above-described Embodiments 2 to 4 keeps a constant gap against the HR 6, therefore a metal high in forming accuracy is used therefor. Aluminum is used in Embodiments 2 to 4. In this case, a toner melted at the time of fixation sticks to the separator 28, the toner is then retransferred to the form printed later, which is capable of causing an erroneous print. To remove such problem, a fluororesin layer 53 high in separativeness from the toner is provided on a surface of the separator 28 in this embodiment. According to this embodiment described above, since the fluororesin layer 53 is provided on the surface of the separator 28, a toner will never stick to the separator 28, and thus an erroneous print due to retransfer will not result.

Embodiment 6

Figure 18:
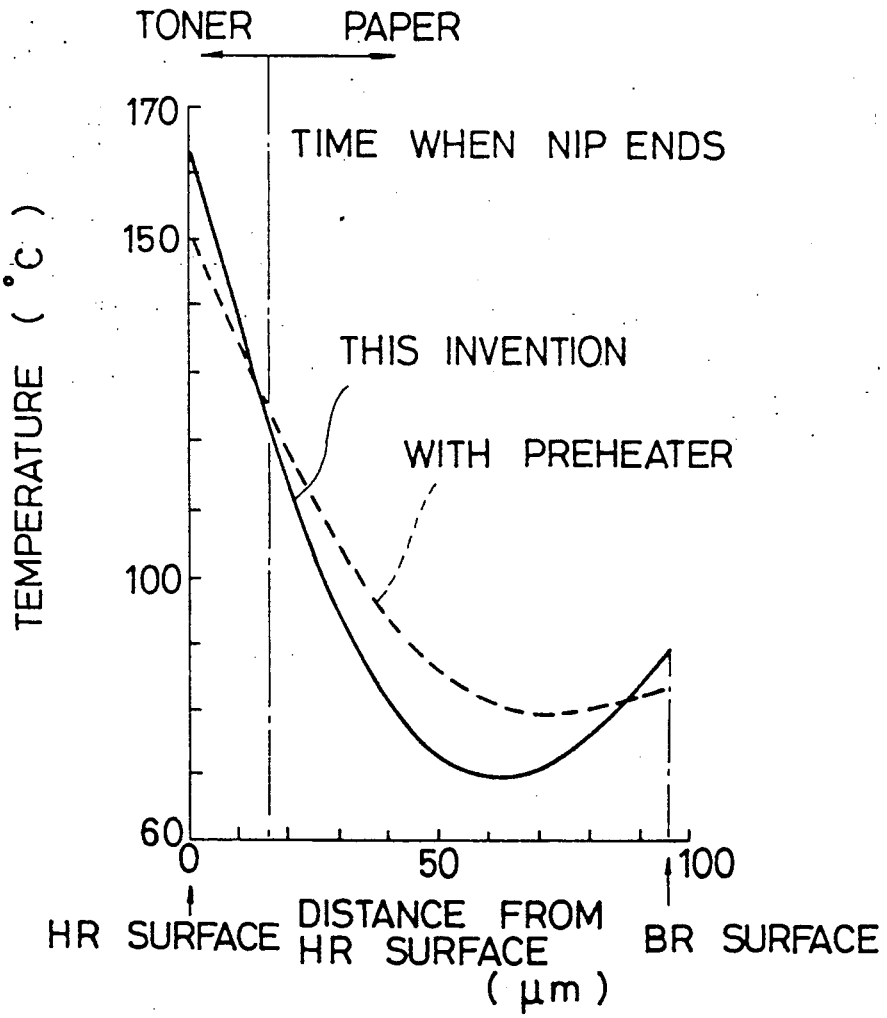
FIG. 18 is a view showing a toner at an outlet of the nip zone and a temperature distribution within the recording paper.

Another embodiment will be described next with reference to FIG. 18 and FIG. 19. FIG. 18 indicates in full line a temperature distribution of the toner and the recording paper at an outlet of the nip zone 23 when a fixation is effected by means of HR 6 and BR 7 described in Embodiment 1, and also indicates in broken line a temperature distribution of the toner and the recording paper at an outlet of the nip zone when a fixation is effected by means of a fixing apparatus with preheater whereby the same fixing strength is obtained (prior art). As shown in FIG. 18, a toner internal temperature gradient according to this invention is large as compared with the prior art. That is, for obtaining the same fixing strength, temperature of the toner surface in contact with the HR 6 is high in the fixing apparatus of this invention as compared with the prior art, but is low to the contrary at an interface of the toner and the paper. The phenomenon is generated as much heat is fed to the toner during the period of nip time in the fixing apparatus of this invention. Then, with such phenomenon a distribution of melting property within the toner such as melting viscosity and the like gets large, and the toner is easy to split vertically during the period of nip time. This may cause the offset phenomenon mentioned hereinbefore to occur. Generally, the offset phenomenon is generated at high temperature (hot offset) and also at low temperature (cold offset), and hence is taken that a non-offset temperature range to the offset phenomenon may be narrow. As described above, in the fixing apparatus of the aforementioned embodiment, the offset phenomenon is easy to occur, and thus the toner (hereinafter called offset toner) transferred onto HR increases, therefore a capacity of the cleaning device for wiping out the toner must be enhanced.

Figure 19:
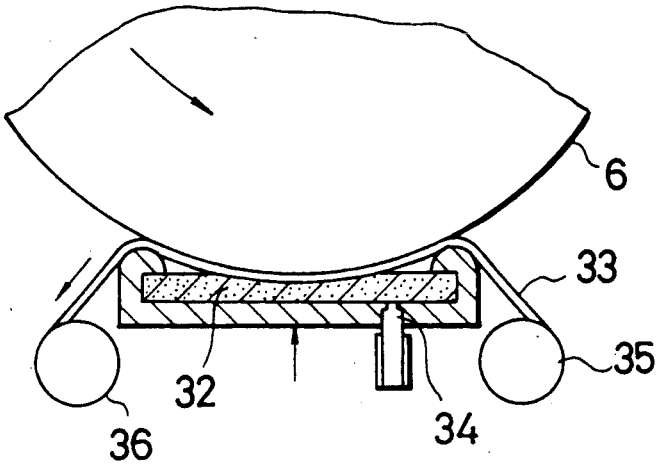
FIG. 19 is a sectional view representing a cleaning device portion of another embodiment of this invention.

FIG. 19 is a sectional view of a cleaning device given in another embodiment of this invention. A reference numeral 32 denotes a push member, 33 denotes a wiping belt, 34 denotes a separating liquid feed port, 35 denotes a let-off roller, and 36 denotes a take-up roller. A separating liquid is fed to the main wick 32 from the separating liquid feed port 34 for enhancing a separativeness of a toner from the HR 6. A silicone oil is used for the separating liquid. The separating liquid permeates the wiping belt 33 through the main wick 32, and is applied to a surface of the HR 6. The wiping belt 33 functions to apply the separating liquid to the HR 6 and also to wipe out the offset toner at the same time. The wiping belt 33 moves from the let-off roller 35 toward the take-up roller 36 in the direction counter to that in which the HR 6 rotates. The wiped out offset toner accumulates on a surface of the wiping belt 33. When too much of the offset toner has accumulated, the offset toner is retransferred to the HR 6 from the wiping belt 33. The wiping belt 33 is moved at all times to prevent the retransfer, thereby renovating a contact surface (wiping surface) of the wiping belt 33 and the HR 6. A moving rate of the wiping belt 33 is set so that the wiping belt 33 will leave from the wiping surface earlier than the retransfer occurs. The wiping belt 33 of this kind of wiping device consists generally of a felt 1 mm or so in thickness. In the case of fixing apparatus of this invention, since the offset toner is much in quantity, a retransfer of the offset toner to the HR 6 is easy to occur. A moving rate of the wiping belt 33 must be increased, consequently. Thus, when using the aforementioned felt is used for the wiping belt 33, a disadvantage is such that the wiping belt 33 is taken up too early. When the wiping belt 33 has been taken up, the wiping belt 33 is normally renewed. That is, the problem is that the period for replacing the wiping belt 33 comes early. To solve the aforementioned problem, if a length of the felt to be taken up one time is increased, then the let-off roller 35 and the take-up roller 36 will be large-sized, involving a difficult for mounting. As means available for solving these problems at a stroke, a thin heat-resisting synthetic paper is used for the wiping belt 33 in this embodiment. The heat-resisting synthetic paper is about 50 μm or below in thickness. Accordingly, a length of the auxiliary wick 33 is increased, and a take-up speed is also increased. Thus, a satisfactory wiping performance is obtained, and further the let-off roller 35 and the take-up roller 36 may be made small in size. According to this embodiment, even from using the HR 6 of Embodiment 1 with much offset toner, a satisfactory wiping performance is obtainable, and further the cleaning device may be made small in construction.

Embodiment 7

Figure 20:
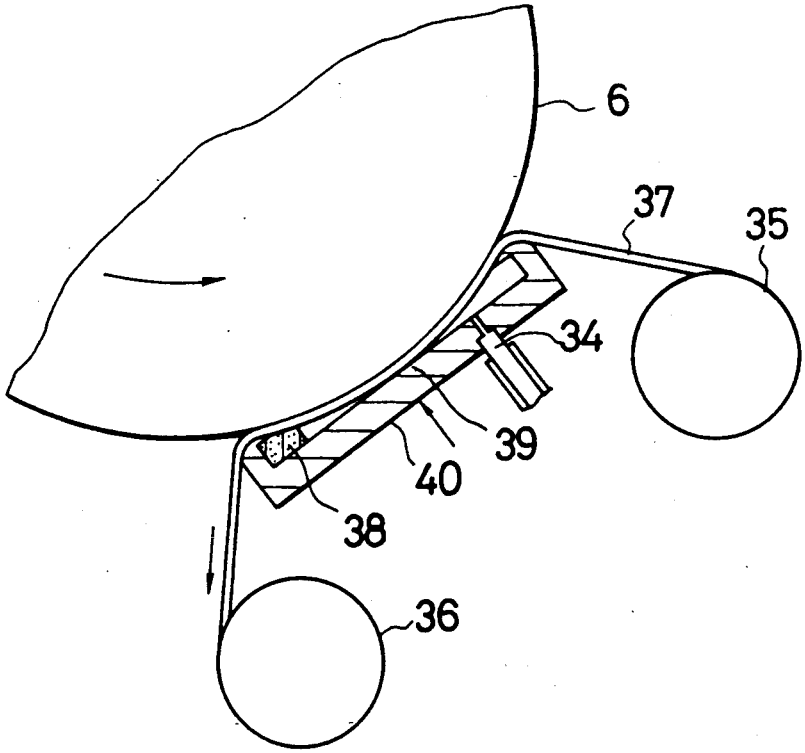
FIG. 20 is a sectional view representing a cleaning device portion of another embodiment of this invention.

Another embodiment will be described with reference to FIG. 20. FIG. 20 is a sectional view of a cleaning device given in another embodiment of this invention. A reference numeral 37 denotes a wiping belt, 38 denotes a push member, 39 denotes a separating liquid feeder, and 40 denotes a support member. In this embodiment, the wiping belt 37 is prepared in one only, and the wiping belt 37 moves against the direction in which the HR 6 rotates. As in the case of Embodiment 6, the moving rate is decided on condition that a retransfer of the offset toner to the HR 6 will not occur. The cleaning device has the support member 40 installed slantingly to a gravity direction (downward). Thus, a separating liquid flows downward after coming out of the separating liquid feed port 34, and is fed to a surface of the HR 6 from the separating liquid feeder 39. A silicone oil is used for the separating liquid. The push member 38 pushes the wiping belt 37 against the HR 6. The position is that for wiping the offset toner in the main. At the separating liquid feed position 39, the offset toner sticks less to the wiping belt 37, thus a resistance is minimized to a feed of the separating liquid, which is ready for feeding smoothly. Then, while the wiping belt 37 moves from the separating liquid feed position 39 to the wiping position, the most part of the separating liquid having permeated the wiping belt 37 transfers to the HR 6 or evaporates, and thus at the wiping position, the separating liquid scarcely permeates the wiping belt 37. Since the separating liquid has an effect in deteriorating a wiping performance for its separativeness, therefore this action is exceedingly effective in combining feeding and wiping of the separating liquid at the same time.

In this embodiment a felt is used for the wiping belt 37, and a clear resin of the same kind as toner is permeated in the felt. It has been confirmed by the inventors that where the resin of the same kind as the toner is not permeated, the wiped-out offset toner is deposited on the felt and does not permeate into the felt in most cases. The wiped-out offset toner can be permeated into the felt by permeating the resin having an affinity with the offset toner. According to the effect, a retainability of the offset toner after being wiped off the roller by the wiping belt 37 is improved, and a retransfer of the offset toner to the HR 6 can be prevented without increasing a moving rate of the wiping belt 37 particularly therefor. According to this embodiment, since the separating liquid feed position and the wiping position are detached from each other, the separating liquid can be fed smoothly, and a wiping performance is high. Further, since a resin having an affinity with the toner is included in the wiping belt 37, a retainability of the offset toner is high, and a retransfer of the offset toner to the HR 6 can be prevented without increasing a moving rate of the wiping belt 37. Accordingly, a satisfactory cleaning performance is obtainable as a cleaning device for the fixing apparatus of Embodiment 1.

Embodiment 8

Figure 21:
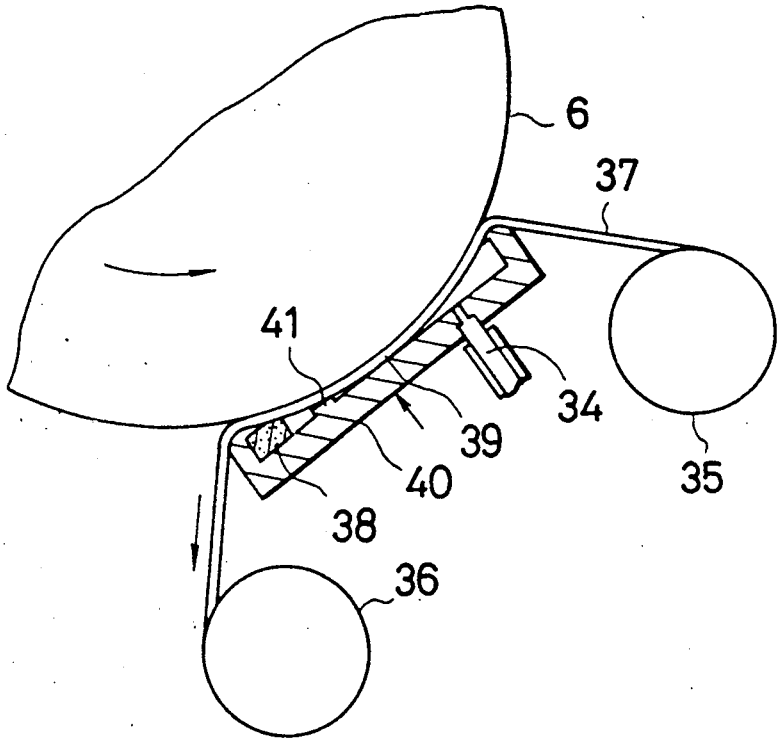
FIG. 21 is a sectional view representing a cleaning device portion of a still another embodiment of this invention.

A variant of Embodiment 7 will be described with reference to FIG. 21. FIG. 21 is a sectional view of a cleaning device given in a variant of Embodiment 7 of this invention. A reference numeral 41 denotes a separating liquid weir portion. Those portions other than the separating liquid weir portion 41 provided as above remain same as Embodiment 7. In Embodiment 7, when the separating liquid is fed excessively, it is not fed to the HR 6 at the separating liquid feed position 39, the extra separating liquid flows as far as a position of the push member 38, and thus is capable of deteriorating a wiping performance. To stop the outflow, there is provided the separating liquid weir portion 41. According to this embodiment, functions for feeding and wiping the separating liquid are isolated thoroughly, and if the separating liquid is fed to excess unexpectedly, the wiping performance will never be deteriorated.

Embodiment 9

Figure 22:
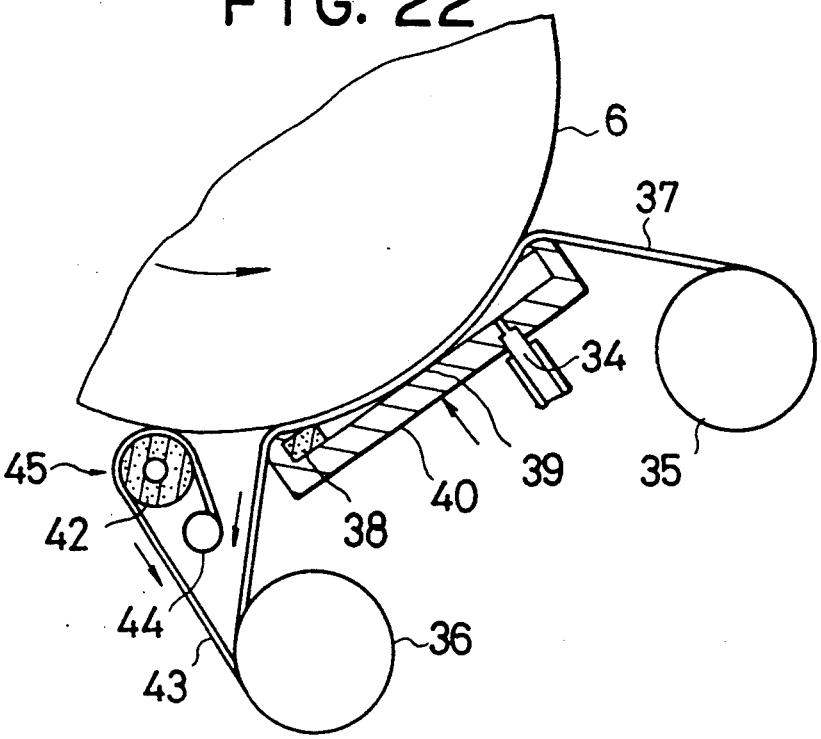
FIG. 22 is a sectional view representing a cleaning device portion of a further embodiment of this invention.

Another embodiment will be described with reference to FIG. 22. FIG. 22 is a sectional view of a cleaning device given in another embodiment of this invention. When using the fixing apparatus of Embodiment 1 and also employing a toner easy to generate offset, there may be a case where the offset toner is hard of wiping thoroughly even from using the wiping devices of Embodiments 6 to 8. A wiping device according to the present embodiment will be useful. A reference numeral 42 denotes a prewiping roller, 44 denotes a second let-off roller, 43 denotes a heat-resisting synthetic paper, these forming a prewiping device 45. Like reference characters represent like parts in the case of Embodiment 7. In this embodiment, the wiping belt 37 and the heat-resisting synthetic paper 43 are taken up concurrently on the take-up roller 36. A felt similar to that of Embodiment 7 is used for the wiping belt 37. That with the thickness 50 μm or so is used for the heat-resisting synthetic paper 43, which is almost same in length as the wiping belt 37. In this case, the second let-off roller 43 can be made small in size as illustrated. The heat-resisting paper 43 turns an outer periphery of the prewiping roller 42 from the let-off roller 44 and reaches the take-up roller 36. The prewiping roller 42 is rotatable, and is applied with a constant load working toward a center of the HR 6. In this embodiment, when the prewiping roller 42 and the HR 6 are brought into contact directly with each other, a pressure arising on the contact surface is set at 1 kg/cm$^2$. The most part of the offset toner generated in the nip zone of the fixing apparatus of Embodiment 1 is wiped out by the heat-resisting synthetic paper 43, and the offset toner left unwiped is also wiped out in the wiping device of the wiping belt 37 described in Embodiment 7. According to the embodiment of this invention described above, since the offset toner can be wiped out by two wiping members of the heat-resisting synthetic paper 43 and the wiping belt 37, a satisfactory wiping performance may be secured even from using a toner easy to offset. When a plurality of wiping members are used, a disadvantage is such that a large-sized construction will be quite unavoidable with the apparatus, however, according to the embodiment of this invention, the felt and the heat-resisting paper are used at the same time, further the take-up rollers are unified into one, therefore such problem will not arise.

Embodiment 10

First a construction of the fixing system 5 will be described according to FIG. 23. As illustrated, the fixing system comprises the heat roll 6, the back-up roll 7, a cleaning device for the heat roll 6 having the wiping member 33, and a cleaning device for the back-up roll 7 constructed of a wiping member 46 and a fixing member 47.

Figure 23:
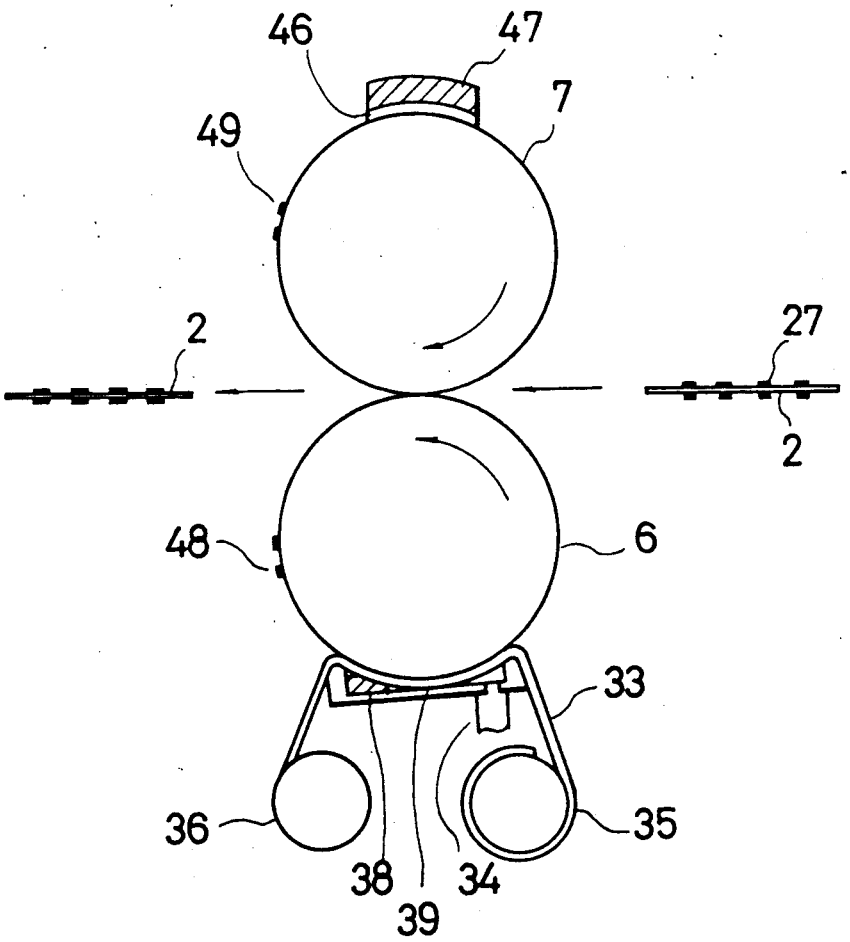
FIG. 23 is a side view showing a construction of a fixing system.

The recording paper 2 having a toner image transferred thereto in the developing system 3 is carried as pinched between the heat roll 6 and the back-up roll 7 in the fixing system shown in FIG. 23, a toner is melted by a heat fed from the heat roll 6 halfway thereof, and is sticked on the recording paper 2. As exemplified in FIG. 23, the recording paper 2 has the toner 27 which is an image already fixed transferred on the surface and a toner which has not yet been fixed transferred on the other surface. Such paper 2 passes between the heat roll 6 and the back-up roll 7 to cause a fixation of the image, however, a part of the toner of the fixed image sticks on the heat roll 6 as a toner 48 in this case, thus staining the heat roll 6. Further, a part of the toner of an image already fixed sticks on the back-up roll 7 as a toner 49, thus staining the back-up roll 7.

Therefore, cleaning devices provided with the wiping members 33, 46 for wiping out the toners 48, 49 as stains are provided each on the heat roll 6 and the back-up roll 7.

The cleaning device for the heat roll 6 comprises disposing the wiping member 33 fed from the storage roller 35 to the take-up roller 36 so as to be pushed halfway against the heat roll 6 by the push member 38. The oil feed port 34 is provided on a member for supporting the push member 36 and the wiping member 33, and a silicone oil which is a remover for peeling the recording paper 2 from the heat roll 6 is fed therefrom. The oil thus fed flows downward on the gravity, and is applied to the heat roll 6 through the wiping member 33 according to a capillary action at the oil feed point 39.

At the time of fixing operation mentioned hereinbefore, the toner 48 having sticked on the heat roll 6 is scraped by fibers of the wiping member 33 of the aforementioned cleaning device, and is taken into a void between the fibers. Thus, with the toner removed and cleaned, the heat roll 6 is ready for fixing the next image.

The wiping member 33 of the aforementioned cleaning device is a sheet member formed of ultrafine fibers, and the member may employ a nonwoven fabric formed by arranging fibers in a random direction as in the case of paper, or a woven fabric formed by weaving a plurality of fibers bundled up into a cloth. Further, where a size of the ultra fine fiber is 20 μm or below as described hereinlater, the wiping performance will remarkably be enhanced, however, the size may preferably be 4 μm or below for better result.

As described above, according to this invention wherein the wiping member 33 is formed of ultrafine fibers, the number of fibers brought into contact with the heat roll may be increased to a great extent, and thus the toner 48 sticking on the heat roll can be scraped off efficiently by the fibers in contact with the heat roll 6. Further, a multiplicity of voids are formed between such many fibers, the wiped-out toner is caught in the voids, and will never restick to the heat roll 6.

In the above-described cleaning device, when the toner wiped out by the wiping member 33 accumulates to some extent, the take-up roller 36 takes up the wiping member 33 from the storage roller 35, and the wiping member 33 coming in contact with the heat roll 6 can be kept from being stained.

Figure 24:
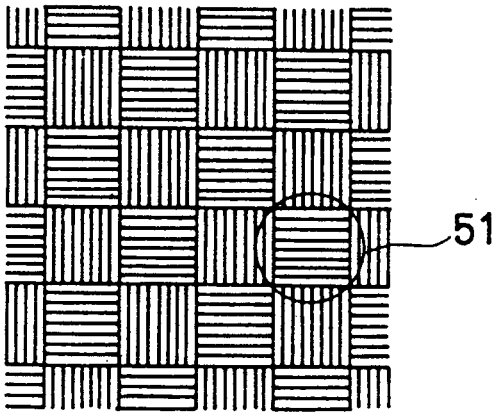
FIG. 24 is a view representing one example of a construction of a wiping member.
Figure 25:
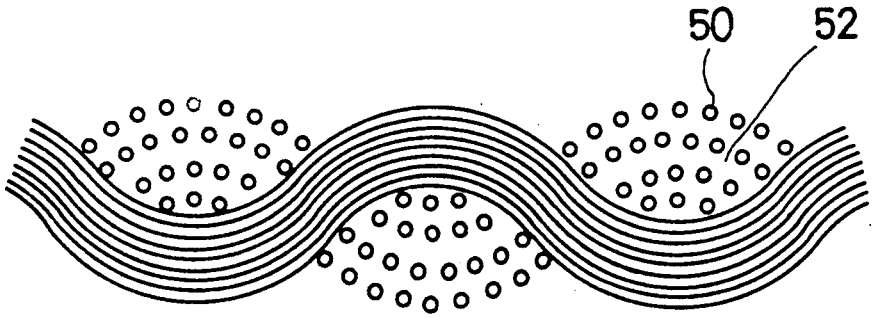
FIG. 25 is an enlarged sectional view of FIG. 24.

FIG. 24 and FIG. 25 are a plan view and a sectional view each representing one example of construction of a fabric where the aforementioned wiping member 33 is the fabric.

The fabric comprises weaving a fiber group 51 bundling a plurality of fibers 50 almost in parallel without applying a torsion as shown in FIG. 24. The fabric constructed as above has the fibers 50 of the fiber group 51 less constrained as compared with the case where fibers are processed into yarn through torsion, and as shown in FIG. 25, a multiplicity of voids 52 are present between the fibers 50.

When using such constructed fabric as the wiping member 33, many fibers 50 come in contact with the heat roll 6, thus a toner on the heat roll 6 can be removed efficiently and securely, and the wiped-out toner is caught securely within the aforementioned voids 52, thereby preventing the toner from resticking to the heat roll 6.

Table 1 shows a result obtained from examining the number of fibers coming in contact with the heat roll and the wiping efficiency when sizes of fibers of the fabric constructed as above are changed by observing toners on the heat roll wiped out. Then, in Table 1, a length of the wiping member coming in contact with the heat roll was specified at 4 mm. Further in Table 1, an example of the strand (fiber) size being 100 μm refers to the case of prior art wiping member such as felt or the like, which results in inferior wiping efficiency.

From Table 1 it is understood that the fiber sizes not longer than 20 μm are effective in improving the wiping efficiency, and still the wiping efficiency is remarkably improved from the fiber sizes coming not longer than 4 μm.

TABLE 1

| Strand size d | Number of contact points n | Wiping efficiency |
|---|---|---|
| 100 μm | 40 | × |
| 80 μm | 50 | Δ |
| 60 μm | 66 | Δ |
| 40 μm | 100 | Δ |
| 20 μm | 200 | |
| 10 μm | 400 | |
| 4 μm | 1,000 | |

d: strand size
l: length coming in contact with the heat roll (4 mm)
n = l/d: number of contact points of fibers coming in contact with the heat roll
×: bad
Δ: a little bad
: good
: very good Then, the fabric shape described according to FIG. 24 is so indicated merely as an example, and hence any shape will do subject to being woven by means of ultrafine fibers and having a void between the fibers.

The embodiment of this invention has been described as above with reference to a cleaning device for the heat roll, however, this invention may also be applied to a cleaning device for the back-up roll and a cleaning device for the photosensitive member.

The cleaning device comprising the wiping member 46 and the fixing member 47 which is shown in FIG. 23 is an example of a cleaning device for the back-up roll, wherein the wiping member 46 is pushed against the back-up roll 7 by the fixing member 47, thereby wiping out the toner 49 sticking on the back-up roll 7. In this case, a sheet member formed of the same ultrafine fibers as those of having been described hereinbefore is used as the wiping member 46.

A wiping principle of the cleaning device for the back-up roll is the same as in the case of the cleaning device for the heat roll. Since the back-up roll is stained less than in the case of heat roll, the aforementioned construction will do, however, it may be constructed as in the case of the cleaning device for the heat roll, otherwise. In this case, however, oil feeding is not required.

Next, the developing system 3 will be described with reference to FIG. 26.

Figure 26:
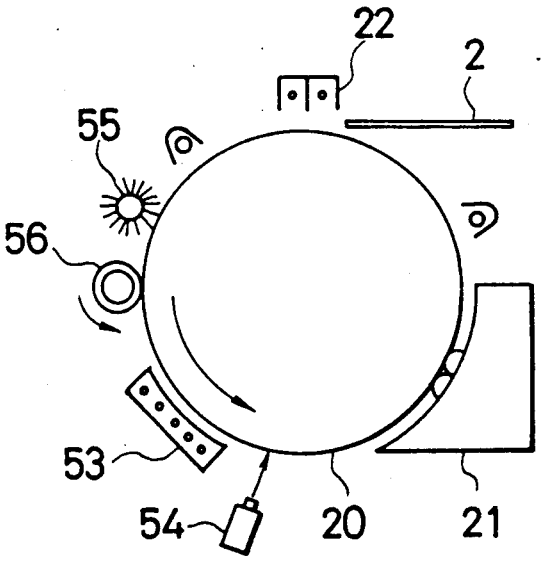
FIG. 26 is a side view representing a construction of a developing system.

In the developing system 3 shown in FIG. 26, the drumshaped photosensitive member 20 is first charged by a charging device 53, an image signal is radiated from a light source 54 as a light, and a charged latent image is formed on the photosensitive member 20. The charged latent image is made visible by the developing device 21 by means of a toner, and is further transferred onto the recording paper 2 carried from the transfer press 22. The recording paper 2 having the toner image transferred thereto is then carried to the fixing system 5 to a fixation of the image as described hereinabove.

At the time when the toner image is transferred onto the recording paper 2, the toner on the photosensitive member 20 is not transferred thoroughly to the recording paper 2 and thus remains partly on the photosensitive member 20. The residual toner is cleaned roughly by a cleaning brush 55, and then removed thoroughly by a cleaning roll 56.

In contact with the photosensitive member 20, the cleaning roll 56 is rotated in the same direction as the photosensitive member 20, and thus a surface of the cleaning roll 56 is pushed against the surface of the photosensitive member 20 and moved in the counter direction to remove the residual toner.

A wiping member formed of ultrafine fibers which is same as that for the cleaning device in the aforementioned fixing apparatus 5 is provided on the surface of the cleaning roll 56, and a toner remaining on the photosensitive member 20 can be removed thoroughly by the wiping member likewise.

In this case, a relation between the fiber size forming the wiping member and the wiping efficiency is same as that of Table 1.

In the aforementioned example, the cleaning device for the photosensitive member 20 is constructed of a cleaning roll, however, the cleaning device for the photosensitive member 20 may take other forms selectively otherwise.

According to the fixing apparatus relating to this invention and the heat roll used therefor, since a surface layer thickness of the heat roll and a thickness of the mandrel are specified, a quantity of heat flowing from the mandrel into the surface layer multiplies during the period of nip time, thus realizing a high fixing strength.

Further, according to the recording apparatus relating to this invention, the mandrel thickness is greater than the thickness on which an influence of the heat flow generated on the heat roll surface during fixation exerts at one feed paper period, therefore a high fixing strength is secured stably to a semiperpetual continuous feeding.

A damage possible due to the heat roll surface layer being formed thin can be minimized by the separator in the fixing apparatus relating to this invention. Further, an offset phenomenon arising for the heat being transferred easily to the heat roll surface from the mandrel can be decreased by the cleaning device in the fixing apparatus relating to this invention.

According to this invention, a toner remaining on the heat roll of the recording apparatus, the back-up roll, the photosensitive member and others will be removed securely, further the wiped-out toner is caught within the wiping member and never resticks to cleaned members, therefore a clear and stainless recording may be realized at all times.

What is claimed is:

1. A fixing apparatus, comprising:

a heat roll provided with a hollow cylindrical mandrel, a heat source disposed within the mandrel, a surface layer provided to cover a surface of the mandrel, a thickness of the surface layer being formed not to exceed the thickness to be determined by a square root of the product of a heat diffusion rate of the surface layer material and a nip time for a form to pass a nip zone, a thickness of said mandrel being formed not less than the thickness to be determined by a square root of the product of a heat diffusion rate of the mandrel material and a one rotational period of the mandrel;

a back-up roll paired with the heat roll;

said nip zone formed at a portion where both the two rolls are opposite each other for fixing a toner to a recording paper passing through the opposing portions;

a separator for separating the recording paper coming out of said nip zone and sticking to said heat roll surface from the heat roll surface;

a cleaning device for removing a toner transferred to the heat roll from the recording paper.

2. The fixing apparatus as defined in claim 1, wherein the surface layer material is a fluororesin, and a thickness of the surface layer is 40 μm or less.

3. The fixing apparatus as defined in claim 2, wherein the mandrel material is an aluminum, a thickness of the mandrel is 6 mm or greater.

4. The fixing apparatus as defined in claim 1, wherein the separator is a separating claw disposed with a clearance with respect to the heat roll surface.

5. The fixing apparatus as defined in claim 4, wherein said clearance is set not to exceed the thickness of the recording paper.

6. The fixing apparatus as defined in claim 4, wherein said clearance is formed variably according to the thickness of the recording paper.

7. The fixing apparatus as defined in claim 4, wherein the separating claw consists of a metal and is provided with a fluororesin layer on the surface.

8. The fixing apparatus as defined in claim 4, wherein a gas nozzle for flowing out a gas and separating the recording paper from the heat roll on the gas flow is provided at a nose of the separating claw on the heat roll side.

9. The fixing apparatus as defined in claim 1, wherein the cleaning device comprises a wiping belt moved from a let-off roller toward a take-up roller and sliding on a surface of said heat roll, a support member for supporting a portion whereat the wiping member slides on the heat roll, and a separating liquid feeder for feeding a separating liquid for enhancing a separativeness of the toner from the heat roll to the wiping belt, said wiping belt consisting of a heat-resisting synthetic paper with its thickness formed almost at 50 μm or less.

10. The fixing apparatus as defined in claim 9, wherein the support member is disposed slantingly so that the separating liquid feeder comes upward, and a push member for pushing the wiping belt against the heat roll is provided on a slant lower end portion of the support member.

11. The fixing apparatus as defined in claim 9, wherein a resin having an affinity with the toner is mixed in the wiping belt.

12. The fixing apparatus as defined in claim 11, wherein the resin is transparent.

13. The fixing apparatus as defined in claim 10, wherein a weir for controlling a flow of the separating liquid is provided on the support member, the weir is positioned above the push member but below the separating liquid feed position which is a main position whereat the separating liquid is absorbed by the wiping belt.

14. The fixing apparatus as defined in claim 9, wherein a prewiping device is provided upstream of the position whereat the wiping belt of the heat roll slides on the heat roll.

15. The fixing apparatus as defined in claim 14, wherein a prewiping belt of the prewiping device is taken up on the take-up roller together with the wiping belt.

16. The fixing apparatus as defined in claim 15, wherein the prewiping belt consists of a heat-resisting synthetic paper.

17. A heat roll for use on a fixing apparatus, comprising:

a hollow cylindrical mandrel having a thickness not less than the thickness to be determined by a square root of the product of a heat diffusion rate of a material of the mandrel and a one rotational period of the mandrel;

a surface layer formed not to exceed the thickness to be determined by a square root of the product of a heat diffusion rate of a surface layer material provided to cover a surface of the mandrel and a nip time for a form to pass a nip zone.

18. The heat roll for use on a fixing apparatus as defined in claim 17, wherein the surface layer material is a fluororesin, a thickness of the surface layer is formed not to exceed 40 μm, and the mandrel material is an aluminum, a thickness of the mandrel is formed not less than 6 mm.

19. A recording apparatus, comprising:

a developing station for producing a toner image not yet fixed on a fed recording paper;

a fixing apparatus having a heat roll provided with a hollow cylindrical mandrel, a heat source disposed within the mandrel, a surface layer provided to cover a surface of the mandrel, a thickness of the surface layer being formed not to exceed the thickness to be determined by a square root of the product of a heat diffusion rate of the surface layer material and a nip time for a form to pass a nip zone, a thickness of said mandrel being formed not less than the thickness to be determined by a square root of the product of a heat diffusion rate of the mandrel material and a one rotational period of the mandrel, a back-up roll paired with the heat roll, said nip zone formed at a portion where both the two rolls are opposite each other for fixing a toner to a recording paper passing through the opposite portion, a separator for separating the recording paper coming out of said nip zone and sticking to said heat roll surface from the heat roll surface, a cleaning device for removing a toner transferred to the heat roll from the recording paper.

20. The recording apparatus as defined in claim 19, wherein the heat roll of the fixing apparatus has the surface layer made of a fluororesin, the surface layer being formed not to exceed 40 μm in thickness, and the mandrel made of an aluminum, the mandrel being formed not less than 6 mm in thickness.

21. A recording apparatus, comprising:

a developing system provided at least with a photosensitive member, a developing device, a transfer device, and a cleaning device for the photosensitive member;

a fixing system provided at least with a heat roll, a back-up roll, a cleaning device for the heat roll, and a cleaning device for the back-up roll;

a sheet member consisting of ultrafine fibers which forms a wiping member for at least one cleaning device of the cleaning device for said photosensitive member, the cleaning device for the heat roll, and the cleaning device for the back-up roll.

22. The recording apparatus as defined in claim 21, wherein said wiping member is a fabric formed of ultrafine fibers.

23. The recording apparatus as defined in claim 21, wherein said wiping member is a fabric woven by a fiber group with a plurality of said ultrafine fibers disposed almost in parallel.

24. The recording apparatus as defined in claim 21, wherein said wiping member is a nonwoven fabric formed of ultrafine fibers.

25. The recording apparatus as defined in claim 21, wherein said ultrafine fibers are 20 microns or below in strand size each.

* * * * *

UNITED STATES PATENT AND TRADEMARK OFFICE

CERTIFICATE OF CORRECTION

PATENT NO. : 5,023,464

DATED : June 11, 1991

INVENTOR(S) : Teruaki Mitsuya, et al

It is certified that error appears in the above-identified patent and that said Letters Patent is hereby corrected as shown below:

| Column | Line | |
|---|---|---|
| 1 | 32 | Change "20" to --the--; delete "after". |
| 2 | 22 | After "unsatisfactory," insert --it is difficult to transfer--. |
| 2 | 23 | After "element" insert --to the HR surface--; after "Thus," delete "the HR surface". |
| 4 | 43 | Change "upper" to --higher--. |
| 7 | 26 | After "FIGS. 1" insert --to 10--. |
| 8 | 19 | After "first" delete ",". |
| 9 | 7 | Change "matters" to --materials--. |
| 9 | 8 | Change "matters" to --materials--. |
| 9 | 10 | Change "matters" to --materials--. |
| 9 | 11 | Change "matters" to --materials--. |
| 9 | 14 | Change "matters" to --materials--. |
| 9 | 44 | Change "q" to --$\dot{q}$--. |
| 9 | 48 | Change "q=" to -- $\dot{q}$= --. |
| 10 | 7 | Change "from" to --by--. |
| 11 | 26 | After "materials" insert --,--. |

UNITED STATES PATENT AND TRADEMARK OFFICE

CERTIFICATE OF CORRECTION

PATENT NO. : 5,023,464

DATED : June 11, 1991

INVENTOR(S) : Teruaki Mitsuya, et al

It is certified that error appears in the above-identified patent and that said Letters Patent is hereby corrected as shown below:

| Column | Line | |
|---|---|---|
| 11 | 27 | Change "FIG. 9 to FIG. 14" to --FIGS. 9 to 14--. |
| 11 | 27 | Change "FIG. 9 to FIG. 11" to --FIGS. 9 to 11--. |
| 11 | 45 | Change "tone" to --toner--. |
| 11 | 53 | Change "tone" to --toner--. |
| 12 | 5 | Change "matters" to --materials--. |
| 12 | 6 | Change "√" to -- $\sqrt{\ }$ --. |
| 12 | 7 | Change "√" to -- $\sqrt{\ }$ --. |
| 12 | 42 | Change "matter" to --material--. |
| 13 | 35 | Change "matter" to --material--. |
| 13 | 58 | Change "√" to -- $\sqrt{\ }$ --. |
| 13 | 59 | Change "√" to -- $\sqrt{\ }$ --. |
| 14 | 4 | Change "0.46 x $)^{1/2}$ = 21.2 i-" to --0.46 x $12)^{1/2}$ = 21.2 (mm)--. |
| 14 | 6 | Change "It" to --If--. |
| 14 | 47 | After "set" insert --at--; after "such" insert --a--; after "small" insert --setting--. |

UNITED STATES PATENT AND TRADEMARK OFFICE

CERTIFICATE OF CORRECTION

PATENT NO. : 5,023,464

DATED : June 11, 1991

INVENTOR(S) : Teruaki Mitsuya, et al

It is certified that error appears in the above-identified patent and that said Letters Patent is hereby corrected as shown below:

| Column | Line | |
|---|---|---|
| 15 | 4 | Change "secular" to --recurring--. |
| 15 | 6 | Change "In the concrete" to --In practice--. |
| 16 | 36 | Delete "using". |
| 16 | 45 | Change "a difficult" to --difficulty--. |
| 18 | 62 | Change "sticked" to --stuck--. |
| 20 | 32 | Change ": good" to --o: good--. |
| 20 | 33 | Change ":very good" to --◎: very good--. |
| 21 | 48 | After "arising" change "for" to --from--. |

Signed and Sealed this

Twenty-second Day of December, 1992

*Attest:*

*Attesting Officer*

DOUGLAS B. COMER

*Acting Commissioner of Patents and Trademarks*